United States Patent [19]

Sasaki

[11] Patent Number: 5,053,324

[45] Date of Patent: Oct. 1, 1991

[54] COLOR PHOTOGRAPHIC LIGHT-SENSITIVE MATERIALS HAVING RED COLOR SATURATION AND INPROVED DISCRIMINATION OF GREEN COLORS

[75] Inventor: Noboru Sasaki, Kanagawa, Japan

[73] Assignee: Fuji Photo Film Co., Ltd., Minami-Ashigare, Japan

[21] Appl. No.: 605,139

[22] Filed: Oct. 29, 1990

Related U.S. Application Data

[63] Continuation of Ser. No. 947,747, Dec. 30, 1986, abandoned.

[30] Foreign Application Priority Data

Jan. 8, 1986 [JP] Japan ..... 61-651

[51] Int. Cl.[5] ..... B03C 1/46; B03C 7/00

[52] U.S. Cl. ..... 430/504; 430/505; 430/506; 430/362; 430/512; 430/554; 430/552

[58] Field of Search ..... 430/514, 505, 506, 362, 430/512, 554, 552

[56] References Cited

U.S. PATENT DOCUMENTS 4,705,744 11/1987 Sasaki et al. ..... 430/505

OTHER PUBLICATIONS

Patent Application Serial No. 751, 961, Noboru Sasaki et al., 7/5/85.

*Primary Examiner*—Charles L. Bowers, Jr.
*Assistant Examiner*—Patrick A. Doody
*Attorney, Agent, or Firm*—Burns, Doane, Swecker & Mathis

[57] ABSTRACT

A silver halide color light-sensitive material comprising, on a support, at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, in which the weight-averaged wavelength λG of spectral sensitivity distribution of the green-sensitive layer is in the range of from 520 nm to 580 nm, the weight averaged wavelength $\lambda_{-R}$ of spectral sensitivity distribution of the interlayer effect received by the red-sensitive layer in the range of from 500 nm to 600 nm is in the range of from 500 nm to 560 nm and the difference, $\lambda_G - \lambda_{-R}$ is 5 nm or more, the material being characterized in that spectral sensitivity distribution $S_{-R}(\lambda)$ of the interlayer effect received by the red-sensitive layer satisfies the following conditions:

(a) the wavelength $\lambda_{31\ R}{}^{max}$ at which $S_{-R}(\lambda)$ is the maximum is in the range of from 490 nm to 560 nm;

(b) the wavelength $\lambda_{-R}{}^{80}$ at which $S_{-R}(\lambda)$ is 80% of $S_{-R}(\lambda_{-R}{}^{max})$ is in the range of from 450 to 534 nm and 512 to 566 nm;

(c) the wavelength $\lambda_{-R}{}^{40}$ at which $S_{-R}(\lambda)$ is 40% of $S_{-R}(\lambda_{-R}{}^{max})$ is in the range of from 400 to 512 nm and 523 to 578 nm.

The material gives a color image with excellent color reproduction and high saturation over the whole visible light region.

24 Claims, 18 Drawing Sheets

SB(λ)
(%)
100
80
60
40
350
400
450
500
550
600
650
WAVELENGTH (nm)
SAMPLE 501
(PRESENT INVENTION)
SAMPLE 205
(PRESENT INVENTION)
SAMPLE 502
(COMPARATIVE EXAMPLE)
SAMPLE 503
(PRESENT INVENTION)

S-B(λ)
40
60
80
100
(%)

COLOR PHOTOGRAPHIC LIGHT-SENSITIVE MATERIALS HAVING RED COLOR SATURATION AND INPROVED DISCRIMINATION OF GREEN COLORS

This application is a continuation of application Ser. No. 07/947,747, filed Dec. 30, 1986 abandoned.

BACKGROUND OF THE INVENTION

1. Field of the Invention

The present invention relates to color photographic light-sensitive materials, more particularly, the invention pertains to color photographic light-sensitive materials having high saturation and which are excellent in color reproduction.

2. Description of the Prior Art

The use of the interlayer inhibiting effect has been known as a useful means for improving color reproduction of color photographic light-sensitive materials. In color negative light-sensitive materials, for instance, the development inhibiting effect from a green-sensitive layer to a red-sensitive layer may inhibit color production in the red-sensitive layer upon white light exposure to a greater extent than upon red light exposure. In a color negative film-color paper system, gradation is balanced so that an exposed area upon white light exposure reproduces gray color on a color print, and therefore the interlayer effect leads to greater cyan dye-formation upon red light exposure than upon gray light exposure. As a result, there may be reproduced from the color negative film a color print with decreased cyan dye-formation, that is, with reproduction of highly saturated red color. Similarly, a development inhibiting effect from a red-sensitive layer to a green-sensitive layer leads to reproduction of green colors having higher saturation.

One of the methods for increasing the interlayer effect so far known is a method using iodide ion released upon development from a silver halide emulsion. In this method, the silver iodide content of the donor layer of the interlayer effect is high, while the silver iodide content of the receptor layer is low. Another method for increasing the interlayer effect is, as described in Japanese Patent Application (OPI) (unexamined published application) No. 50-2537, one in which the donor layer of the interlayer effect includes a coupler which reacts with the oxidation products as of a paraphenylene diamine type color developer to release a development inhibiting compound. Still another method for increasing the interlayer effect is one called an auto-masking method in which a colored coupler is incorporated in an uncolored coupler-containing layer to mask unwanted absorption of the colored dye produced upon development from the uncolored coupler. According to this method, it is possible to obtain an effect similar to the interlayer effect by increasing the amount of the colored coupler incorporated so that masking is effected to a greater extent than that necessary to mask the unwanted absorption of the colored dye produced from the uncolored coupler.

The increase in the saturation of primary colors, i.e., red, green and blue according to any one of these methods leads to a problem such that the hue of yellowish or cyanic green cannot be reproduced faithfully. To solve this problem, a method has been proposed, which is, for instance, disclosed in Japanese Patent Appln. (OPI) No. 61-34541 (USSN 751,961, EP 85108369.1). This technique intends to accomplish a color image with a faithful color reproduction and having a good sharpness by providing a silver halide color light-sensitive material comprising on a support at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, in which the weight-averaged wavelength ($\lambda_G$) of spectral sensitivity distribution of said green-sensitive silver halide emulsion layer is in the range of between 520 nm and 580 nm, the weight-averaged wavelength ($\lambda_{-R}$) of the wavelength distribution of the interlayer effect received by said red-sensitive silver halide emulsion layer in the range of between 500 nm and 600 nm is in the range of between 500 nm and 560 nm and the difference ($\lambda_G - \lambda_{-R}$) is 5 nm or more.

In this respect, the weight-averaged wavelength ($\lambda_{-R}$) of the wavelength distribution of the interlayer effect received by the red-sensitive silver halide emulsion layer in the range of between 500 nm and 600 nm can be obtained as follows:

(1) The cyan dye-forming red-sensitive layer which is sensitive to radiation having a wavelength longer than 600 nm is uniformly exposed through a red filter (which transmits only radiation to which the red-sensitive layer is sensitive and to which the other layers are insensitive) or an interference filter (which transmits only radiation having a specific wavelength) to uniformly fog the cyan dye-forming red-sensitive layer to an appropriate optical density.

(2) The spectrum exposure is made to cause the interlayer development inhibiting effect on the fogged emulsion layer from the blue-sensitive and the green-sensitive layers. As a result, a reversal image is obtained (see FIG. 1A).

(3) From this reversal image, the spectral sensitivity distribution $S_{-R}(\lambda)$ as a reversal light-sensitive material is found. The relative value of $S_{-R}(\lambda)$ at a specific wavelength ($\lambda$) can be found at the point (a) in FIG. 1A.

(4) The weight-averaged wavelength ($\lambda_{-R}$) of the interlayer effect is calculated according to the following equation:

$$\lambda_{-R} = \frac{\int_{500\text{ nm}}^{600\text{ nm}} \lambda \cdot S_{-R}(\lambda)d\lambda}{\int_{500\text{ nm}}^{600\text{ nm}} S_{-R}(\lambda)d\lambda}$$

While the weight-averaged wavelength ($\lambda_G$) is defined by the following equation.

$$\lambda_G = \frac{\int_{500\text{ nm}}^{600\text{ nm}} \lambda \cdot S_G(\lambda)d\lambda}{\int_{500\text{ nm}}^{600\text{ nm}} S_G(\lambda)d\lambda}$$

wherein $S_G(\lambda)$ is a spectral sensitivity distribution curve for a green-sensitive layer and the relative value of $S_G(\lambda)$ at a specific wavelength ($\lambda$) can be found at the point (b) in FIG. 1B.

According to procedures similar to those discussed above, spectral sensitivity distributions $S_{-B}(\lambda)$ and $S_{-G}(\lambda)$ can be obtained by selecting a suitable interference filter, fogging the blue-sensitive and the green-sensitive layers and then exposing a light of equienergy spectrum to the fogged layers.

However, it is quite difficult to always reproduce faithfully, colors of the spectral light over the whole range of wavelength of visible light with utilizing such a light-sensitive material. U.S. Pat. No. 3,672,898 discloses a method which comprises limiting the spectral sensitivity distributions of the blue-sensitive, the green-sensitive and the red-sensitive silver halide emulsion layers to a certain range to provide a photographic light-sensitive material which makes it possible to faithfully reproduce colors and restrict the occurence of drastic change in the color reproduction even if it is exposed to a variety of light sources.

The inventors of this invention have conducted studies on various kinds of combinations of these methods described above except for Japanese Patent Appln. (OPI) No. 61-34541 to develop a photographic light-sensitive material capable of faithful color reproduction over a wide spectral range of visible light. However, a light-sensitive material which sufficiently meets the requirements for both saturation and faithfulness of hue has never been obtained. Possible reasons for this are as follows:

(i) If the spectral sensitivity is restricted to the range disclosed in U.S. Pat. No. 3,672,898, the color saturation of the resulting light-sensitive material is highly reduced;

(ii) If DIR compounds disclosed in Japanese Patent Application (OPI) No. 50-2537 are used to compensate the reduction in saturation or a strong masking with a colored coupler is effected to increase the color saturation, there is observed an inhibitory effect at the portion on which the spectral sensitivity distribution of blue-sensitive, green-sensitive and red-sensitive silver halide emulsion layers are overlapped with each other. As a result, a distortion of the spectral sensitivity distribution occurs, which leads to the deviation in hue.

SUMMARY OF THE INVENTION

Accordingly, the principal object of this invention is to provide a color photographic light-sensitive material which provides the faithful spectral color reproduction over the whole visible light range, the faithful reproduction of delicate hue and a high saturation. In particular, there is provided a color photographic light-sensitive material which makes it possible to reproduce delicate hue such as red and orange, yellow and yellow-green, blue and purple, blue and cyan color or the like which cannot be reproduced with color photographic light-sensitive materials of the prior art.

The above mentioned and other objects can be accomplished by providing a silver halide color photographic light-sensitive material comprising, on a support, at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, the weight-averaged wavelength ($\lambda_G$) of spectral sensitivity distribution of the green sensitive silver halide emulsion layer being in the range of from 520 nm to 580 nm, the weight-averaged wavelength ($\lambda_{-R}$) of the wavelength distribution of the interlayer effect received by the red-sensitive silver halide emulsion layer in the range of from 500 nm to 600 nm being in the range of from 500 nm to 560 nm and the difference ($\lambda_G - \lambda_{-R}$) being 5 nm or more, characterized in that the wavelength distribution of the interlayer effect $S_{-R}(\lambda)$ satisfies the following conditions:

(a) The wavelength $\lambda_{-R}^{max}$ at which $S_{-R}(\lambda)$ is the maximum is in the range of from 490 nm to 560 nm;

(b) The wavelength $\lambda_{-R}^{80}$ at which $S_{-R}(\lambda)$ is equal to 80% of $S_{-R}(\lambda_{-R}^{max})$ is in the range of from 450 nm to 534 nm and from 512 nm to 566 nm; and (c) The wavelength $\lambda_{-R}^{40}$ at which $S_{-R}(\lambda)$ is equal to 40% of $S_{-R}(\lambda_{-R}^{max})$ is in the range of from 400 nm to 512 nm and from 523 nm to 578 nm.

BRIEF DESCRIPTION OF THE DRAWINGS

The silver halide color light-sensitive materials according to the present invention will now be described in more detail with reference to the following attached drawings; wherein.

DETAILED EXPLANATION OF THE INVENTION

We have conducted studies on color light-sensitive materials which receive a large interlayer effect caused by color masking and DIR compounds to obtain the conditions for designing light-sensitive materials having faithful color reproduction and found that the faithfulness of the color reproduction of such light-sensitive materials can quantitatively be determined by examining the reproduction of spectral light mixed with white light. According to this method, the spectral light mixed with white light, i.e., the spectral light, the excitation purity (Pe) of which is reduced, is used. This is because, the influence of the interlayer effect is not observed when only one of the blue-, green- and red-sensitive layers upon exposure to a pure spectral light is exposed and the color photographic light-sensitive materials are, in general, used to take a photograph of a reflective body having impure color in some degree as the object.

A new method for measuring the faithfulness of the color reproduction will now be explained hereinunder.

(Process 1)

A color light-sensitive material is successively exposed to an equienergy spectral light having a wavelength falling within the range of from 400 nm to 700 nm and a constant excitation purity (Pe) as defined by CIE at 1931, in an interval of 10 nm. Simultaneously, it is exposed to standard source C defined by CIE.

(Process 2)

The color reversal material is developed as it is and the color negative material is printed on a color print material so that the portion previously exposed to standard source C defined by CIE becomes gray and is then developed.

(Process 3)

The chromaticity of the reproduced positive image is determined with a chromaticity measuring apparatus, SS Color Computer (Suga Electric Co., Ltd.) and plotted on the CIE xy chromaticity diagram (1931).

(Process 4)

Figure 1A:
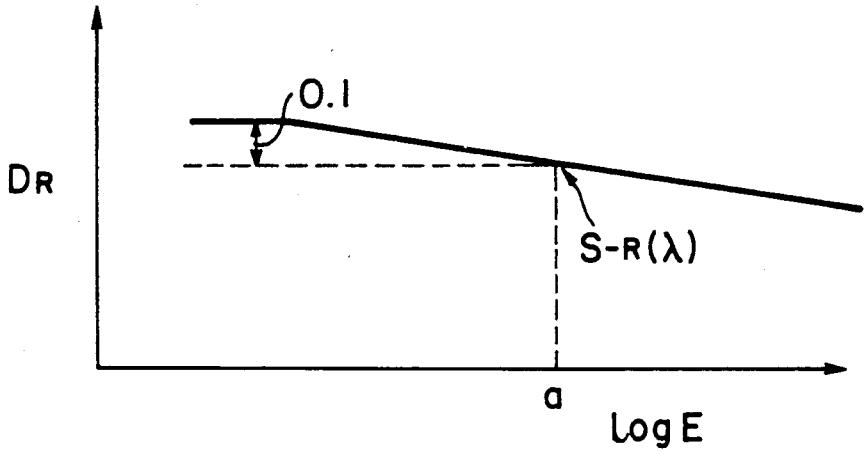
FIG. 1A is a characteristic curve of the reversal image obtained when the red-sensitive layer receives the interlayer effect at each λ from other layers.
Figure 1B:
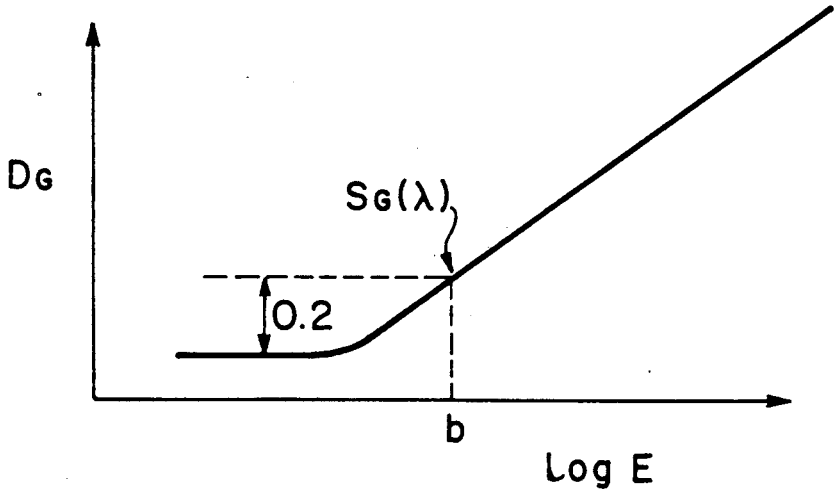
FIG. 1B shows a characteristic curve of the green-sensitive layer observed at each λ.
Figure 2:
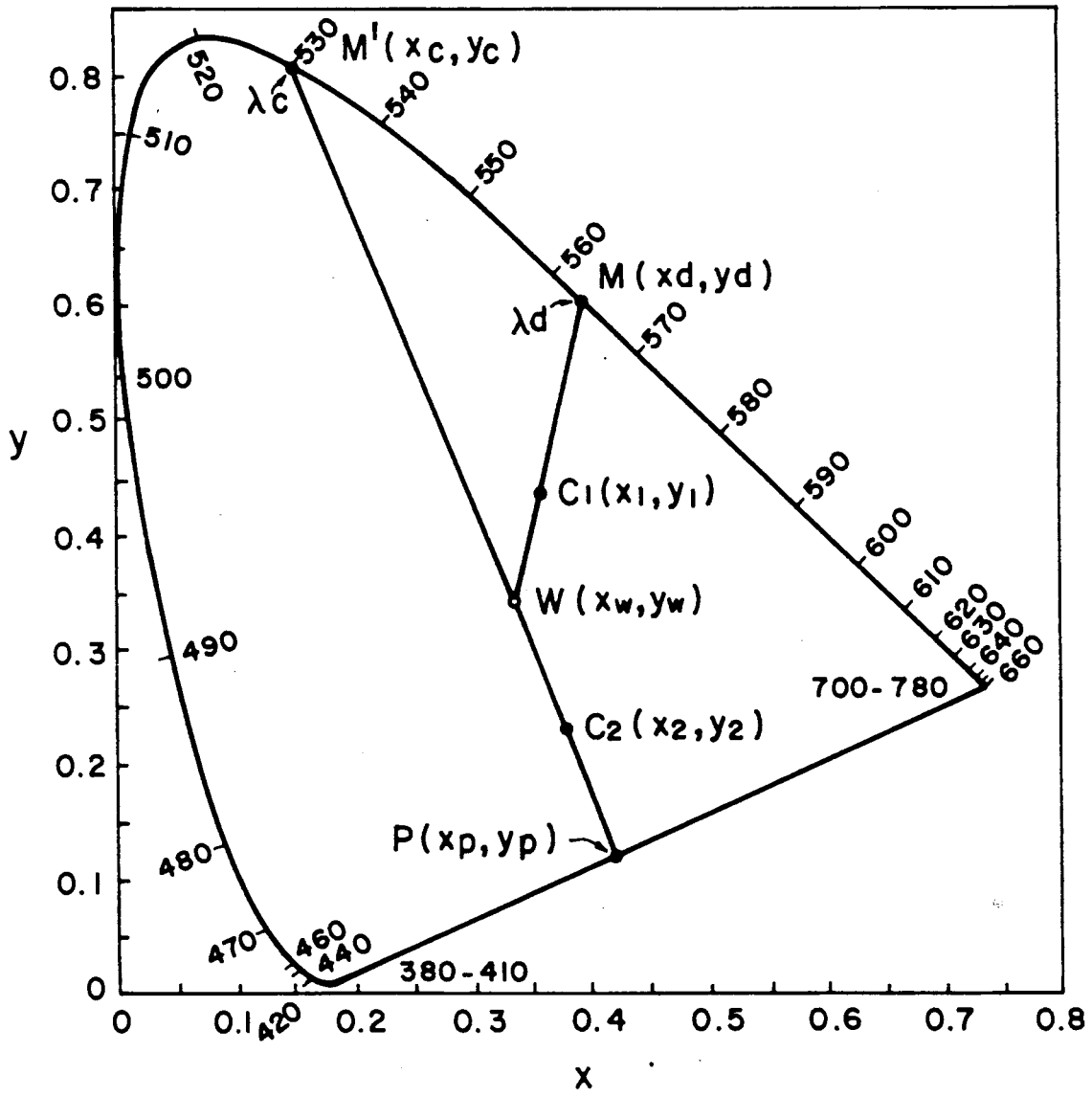
FIG. 2 is a diagram to explain the method for obtaining the dominant wavelength of the reproduction of a color print.
Figure 3:
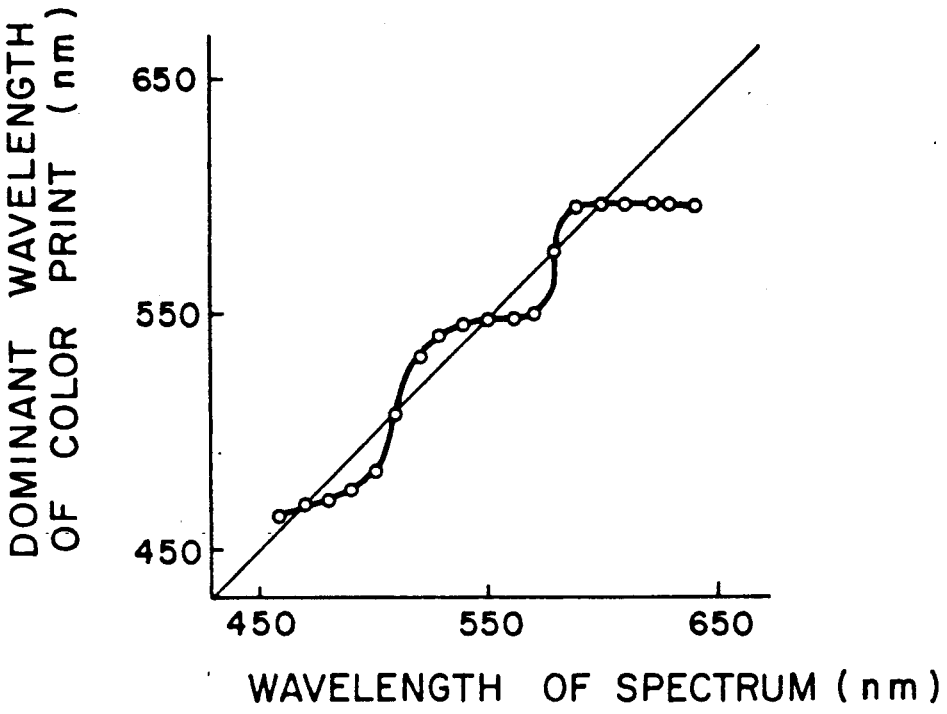
FIG. 3 shows results of the color reproduction test on light-sensitive materials, in which the open circle (o) represents each measured value, the abscissa is the maximum transmission of interference spectrum used for exposure and the ordinate is the dominant wavelength of the color reproduced on a color paper.

The dominant wavelength of the reproduced image is determined by diagramming a figure on the chromaticity diagram as shown in FIG. 2 and the interrelation between the dominant wavelength and the wavelength of the spectral light used to expose is diagrammed as shown in FIG. 3. In FIG. 2, $C_1$, represents the reproduced chromaticity value and λd the dominant wavelength of image. In addition, the excitation purity (Pe) can be calculated according to the following equation:

$$Pe = \frac{X_1 - X_w}{Xd - Xw}$$

The greater the value Pe or the longer the distance between $C_1$, and standard source C(W), the higher the saturation becomes.

As seen from the graph obtained according to the processes 1 to 4, the more the wavelength of the spectral light used to expose the light-sensitive material is consistent with the reproduced dominant wavelength, that is, they are in a linear relationship, the better the color reproduction becomes. We have continued the study on this method and consequently found that it is incomplete, in order to secure the faithful color reproduction of spectral light over the whole visible light region with respect to the light-sensitive material having a large interlayer effect, for the weight-averaged wavelength ($\lambda_G$) of spectral sensitivity distribution of the green-sensitive layer and the weight-averaged wavelength ($\lambda_{-R}$) of the wavelength distribution of the interlayer effect received by the red-sensitive silver halide emulsion layer, containing a cyan dye-forming color coupler, in the range of from 500 nm to 600 nm to simply satisfy the following three conditions:

$520\ \text{nm} \leqq \lambda_G \leqq 580\ \text{nm}$;

$500\ \text{nm} \leqq \lambda_{-R} \leqq 560\ \text{nm}$; and $\lambda_G - \lambda_{-R} \geqq 5\ \text{nm}$ as disclosed in Japanese Patent Application (OPI) No. 61-34541; and further found that it is quite important to, in particular, restrict the distribution $S_{-R}(\lambda)$ of the interlayer effect received by the red-sensitive layer and the spectral sensitivity distribution $S_G(\lambda)$ of the green-sensitive layer to a suitable range. Moreover, it has also been found that the spectral sensitivity distributions $S_B(\lambda)$ and $S_R(\lambda)$ of the blue-and red-sensitive layers as well as the distributions $S_{-B}(\lambda)$ and $S_{-R}(\lambda)$ of the interlayer effect received by these layers have preferred ranges, respectively.

These spectral sensitivity distributions may be obtained according to a conventional technique, for example, by selecting a suitable sensitizing dye or by utilizing a diffusible dye or a fixed dye such as a yellow filter, an ultraviolet ray absorbing filter. Moreover, to compensate the distortion of the spectral sensitivity distribution due to the light absorption by upper layers, it may be possible to slightly change the spectral sensitivity distributions of layers (e.g. the red-sensitive layers) having the same color sensitivity but different speed. The distribution of the interlayer effect may be changed by suitably selecting the amount of a masking coupler, a DIR compound, an adsorptive antifoggant or the layer to which these compounds are added. Moreover, it is also possible to select the layer construction liable to be affected by the interlayer effect by, for instance, reducing a silver/coupler ratio or using a coupler of a low chromophoric activity.

In the silver halide color photographic light-sensitive materials according to the invention, the particularly preferred ranges of $\lambda_{-R}^{max}$, $\lambda_{-R}^{80}$ and $\lambda_{-R}^{40}$ are as follows:

(i) $505\ \text{nm} \leqq \lambda_{-R}^{max} \leqq 545\ \text{nm}$;

(ii) $492\ \text{nm} \leqq \lambda_{-R}^{80} \leqq 529\ \text{nm}$; and $517\ \text{nm} \leqq \lambda_{-R}^{80} \leqq 551\ \text{nm}$;

(iii) $471\ \text{nm} \leqq \lambda_{-R}^{40} \leqq 507\ \text{nm}$, and $528\ \text{nm} \leqq \lambda_{-R}^{40} \leqq 563\ \text{nm}$.

According to another embodiment of this invention, there is provided a silver halide color light-sensitive material comprising, on a support, at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, in which the weight-averaged wavelength ($\lambda_G$) of spectral sensitivity distribution of the green-sensitive silver halide emulsion is in the range of from 520 nm to 580 nm, the weight-averaged wavelength ($\lambda_{-R}$) of the wavelength distribution of the interlayer effect received by the red-sensitive silver halide emulsion layer in the range of from 500 nm to 600 nm is in the range of from 500 nm to 560 nm and the difference between $\lambda_G$ and $\lambda_{-R}$ ($\lambda_G-\lambda_{-R}$) is 5 nm or more, characterized in that the spectral sensitivity distribution $S_G(\lambda)$ of the green-sensitive layer satisfies the following conditions:

(a) The wavelength $\lambda_G^{max}$ at which $S_G(\lambda)$ is the maximum is in the range of from 527 nm to 580 nm;

(b) The wavelength $\lambda_G^{80}$ at which $S_G(\lambda)$ is equal to 80% of $S_G(\lambda_G^{max})$ is in the range of from 515 nm to 545 nm and from 551 nm to 590 nm;

(c) The wavelength $\lambda_G^{40}$ at which $S_G(\lambda)$ is equal to 40% of $S_G(\lambda_G^{max})$ is in the range of from 488 nm to 532 nm and from 568 nm to 605 nm. In this embodiment, the particularly preferred ranges of $\lambda_G^{max}$, $\lambda_G^{80}$ and $\lambda_G^{40}$ are as follows:

(i) 535 nm$\leqq\lambda_G^{max}\leqq$560 nm;

(ii) 515 nm$\leqq\lambda_G^{80}\leqq$538 nm, and 551 nm$\leqq\lambda_G^{80}\leqq$578 nm;

(iii) 488 nm$\leqq\lambda_G^{40}\leqq$520 nm, and 568 nm$\leqq\lambda_G^{40}\leqq$595 nm.

Preferred examples of the silver halide color light-sensitive material according to the present invention include those which simultaneously satisfy the above described conditions on $\lambda_{-R}^{max}$, $\lambda_{-R}^{80}$ and $\lambda_{-R}^{40}$ as well as $\lambda_G^{max}$, $\lambda_G^{80}$ and $\lambda_G^{40}$ and the particularly preferred are those which simultaneously satisfy, the above described preferred conditions on these wavelengths.

In the emulsion layers of the photographic light-sensitive material according to this invention, there may be used any of silver bromide, silver bromoiodide, silver bromochloroiodide, silver chlorobromide and silver chloride. A preferred silver halide is silver bromoiodide or silver bromochloroiodide containing 30 mole % or less of silver iodide. A particularly preferred one is silver bromoiodide containing 2 to 25 mole % of silver iodide.

Silver halide grains in the photographic emulsion may have a regular crystal structure such as a cubic, octahedral or tetradecahedral structure, an irregular crystal structure such as a spherical structure, a crystal structure having crystal defect such as twined crystal surface, or a composite crystal structure.

The size of silver halide grains may be as small as about 0.1 micron or less or as large as about 10 microns in diameter calculated from projected area. The silver halide emulsion employed in this invention may be of monodisperse type having narrow distribution of grain size or of polydisperse type having broad distribution.

The silver halide photographic emulsion which can be used in the present invention may be prepared according to any one of conventional methods such as those disclosed in Research Disclosure, No. 17643, pp 22–23 (Dec., 1978) (I. Emulsion preparation and types) and Research Disclosure, No. 18716, p 648 (Nov., 1979).

The photographic emulsion used in this invention can be prepared in any manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammoniacal pr[illegible]s, etc., can be employed.

Soluble silver salts and soluble halogen salts can be reacted by techniques such as a single jet process, a double jet process, or a combination thereof. In addition, there can be used a method in which silver halide grains are formed in the presence of excess silver ions (so-called reverse mixing process).

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The silver halide emulsion containing grains having regular crystal structure can be obtained by controlling pAg and pH during the formation of silver halide grains. Details are described in, e.g., *Photographic Science and Engineering,* Vol. 6, pp 159–165 (1962); *Journal of Photographic Science,* Vol. 12, pp 242–251 (1964), U.S. Pat. No. 3,655,394 and British Patent 1,413,748.

Moreover, examples of the monodisperse type emulsion are those containing silver halide grains having an average particle size of about 0.1 μm or more in which at least 95 wt % thereof are within the average grain size ±40%. In the present invention, there can preferably be used an emulsion containing silver halide grains, at least about 95 wt % of the silver halide grains or at least 95% thereof based on the total grain number, being within the average grain size ±20%. Such emulsions can be prepared according to a method disclosed in U.S. Pat. Nos. 3,574,628 and 3,655,394 and British Patent No. 1,413,748.

Monodisperse emulsions are described in Japanese Patent Application (OPI) Nos. 48-8600, 51-39027, 51-83097, 53-137133, 54-48521, 54-99419, 58-37635 and 58-49938, Japanese Patent Publication No. 47-11386, U.S. Pat. No. 3,655,394, British Patent 1,413,748, etc.

Tabular grains having an aspect ratio of 5 or more can be employed in this invention. Tabular grains can easily be prepared according to a method as described in Cleve, *Photography Theory and Practice* (1930), p. 131; Gutoff, *Photographic Science and Engineering,* Vol. 14, pp 248–257, (1970); U.S. Pat. Nos. 4,434,226, 4,414,310, and 4,433,048 and British Patent No. 2,112,157. The use of tabular grains improves color sensitizing efficiency, graininess and sharpness by sensitizing dye, details of which are described in U.S. Pat. No. 4,434,226, supra.

Silver halide grains may have a uniform crystalline structure in which the inner and the outer portions differ in halide composition from each other, or may have a layer structure. These silver halide grains are described in, e.g., British Patent No. 1,027,146, U.S. Pat. Nos. 3,505,068 and 4,444,877 and Japanese Patent Application No. 58-248469. Silver halide grains which are joined to silver halide grains of different compositions or to such compounds as silver rhodanide or lead oxide through epitaxial junction can also be employed. These silver halide grains are described in U.S. Pat. Nos. 4,094,684, 4,142,900, 4,459,353, 4,349,622, 4,395,478, 4,433,501, 4,463,087, 3,656,962 and 3,852,067, British Patent No. 2,038,792 and Japanese Patent Application (OPI) No. 59-162540, etc. A mixture of grains having various crystal forms can be employed.

The emulsion of this invention is, in general, subjected to physical ripening, chemical ripening and spectral sensitization before practical use. The additives used in such processes are disclosed in Research Disclosure Nos. 17643 and 18716, the passages concerned of which are summarized in the following Table.

Known additives for photography which may herein be used are also disclosed in the aforecited Research Disclosure and the passages disclosing these additives are specified in the following Table.

| Additive | RD17643 | RD18716 |
|---|---|---|
| 1. Chemical sensitizing agent | page 23 | page 648, right column |
| 2. Sensitivity enhancing agent | | page 648, right column |
| 3. Spectral sensitizing agent, Supersensitizing agent | pages 23 and 24 | page 648, right column to page 649, right column |
| 4. Brightener | page 24 | |
| 5. Antifoggant, Fogging stabilizing agent | pages 24 and 25 | page 649, right column |
| 6. Light absorbing agent, Filter dye, UV absorbing agent | pages 25 and 26 | page 649, right column to page 650, left column |
| 7. Antistain agent | page 25, right column | page 650, left to right column |

-continued

| Additive | RD17643 | RD18716 |
|---|---|---|
| 8. Dye image stabilizer | page 25 | |
| 9. Hardening agent | page 26 | page 651, left column |
| 10. Binder | page 26 | page 651, left column |
| 11. Plasticizer, Lubricant | page 27 | page 650, right column |
| 12. Coating aid, Surfactant | pages 26 and 27 | page 650, right column |
| 13. Antistatic | page 27 | page 650, right column |

The weight averaged wavelength $\lambda_{-R}$ of the spectral sensitivity distribution of the emulsion layers which exert the interlayer effect on the red-sensitive layer is preferably from 500 nm to 560 nm, particularly from 500 nm to 530 nm. The sensitizing dye as used herein should not be restricted to those having a specific structure and may be selected from the group consisting of those described above. Preferred examples thereof are as follows:

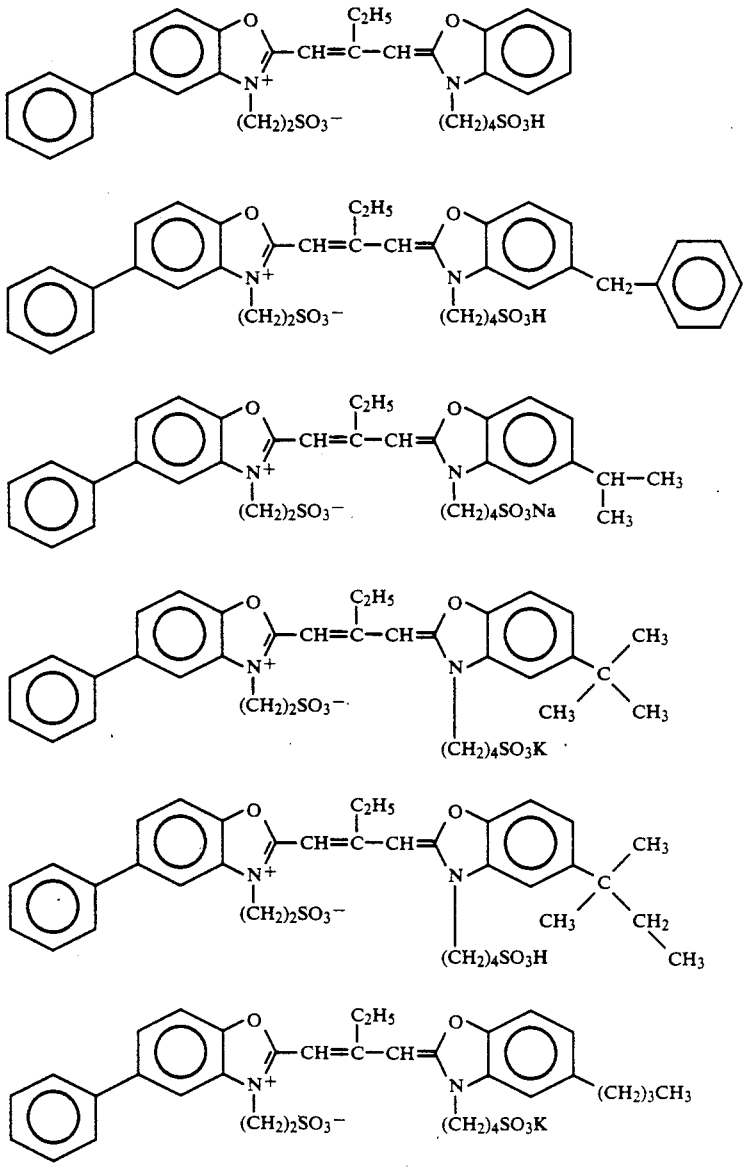

-continued
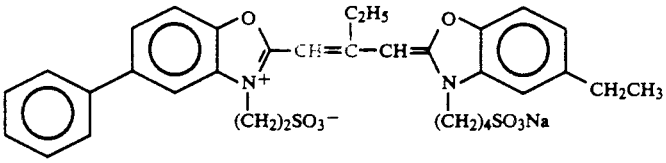
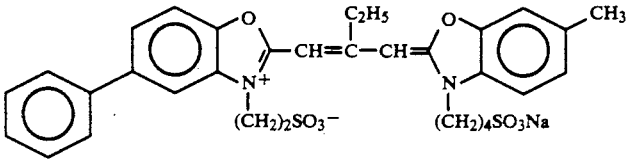
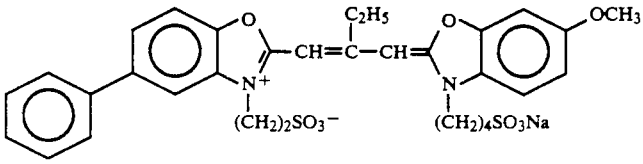
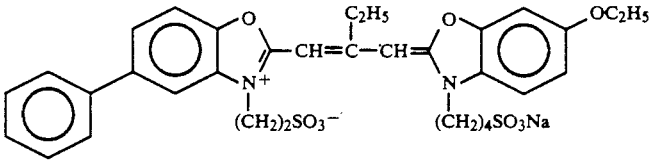
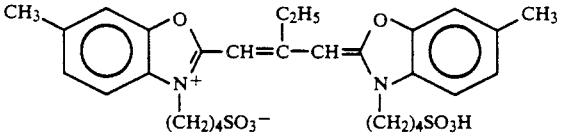
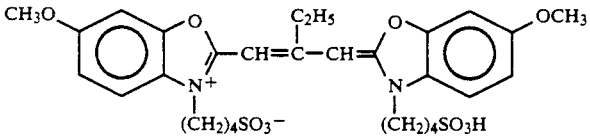
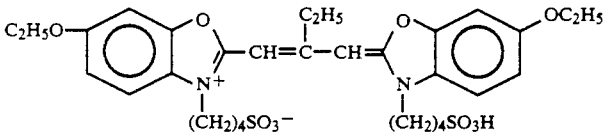
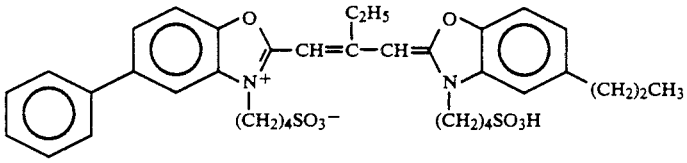
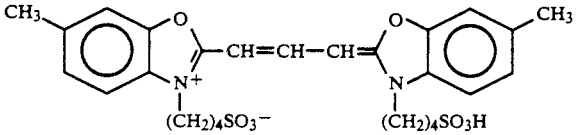
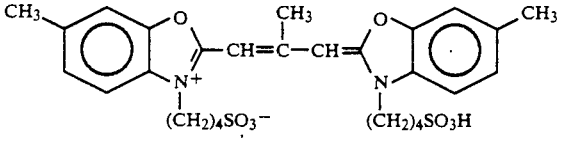

-continued
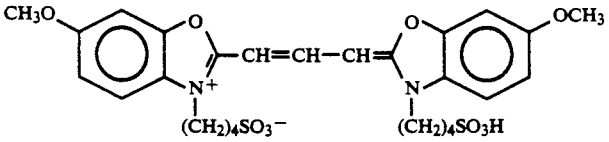
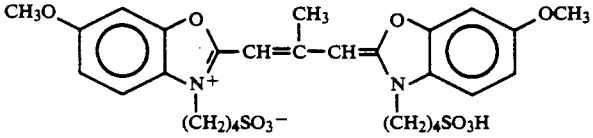
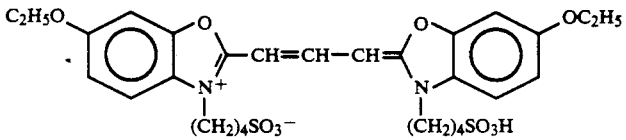
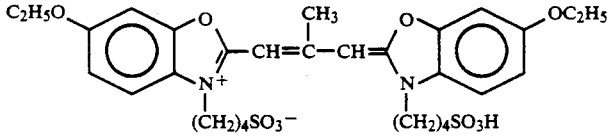
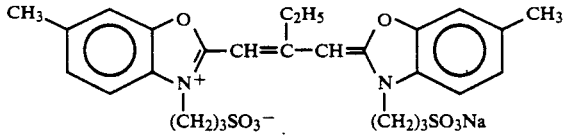
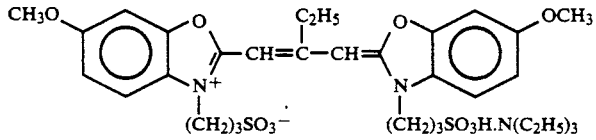
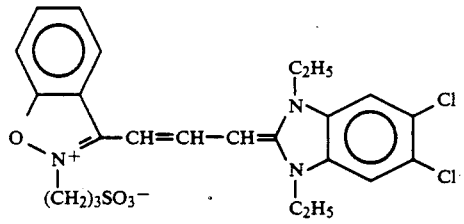
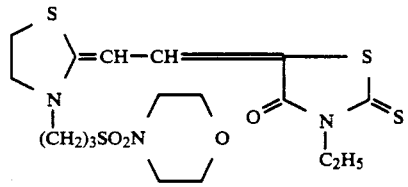
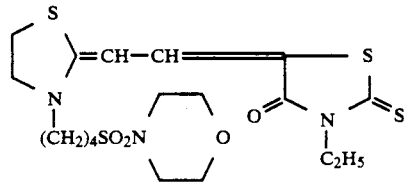

-continued
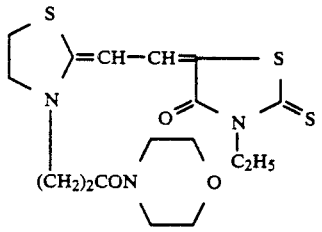
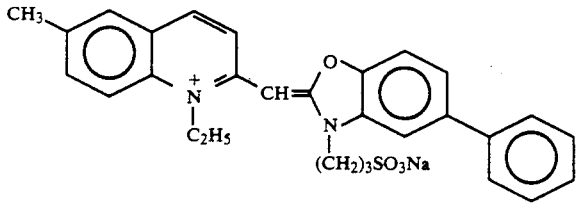
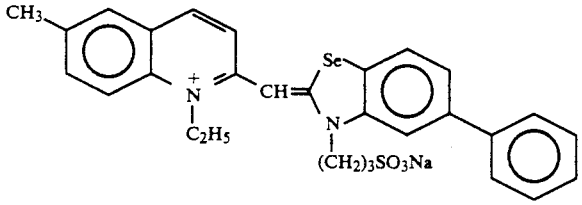
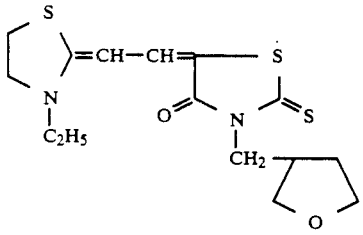
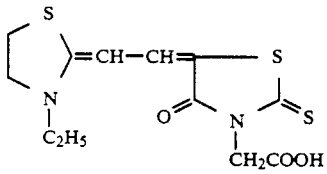
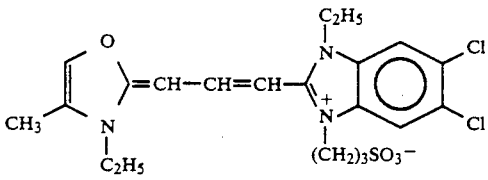
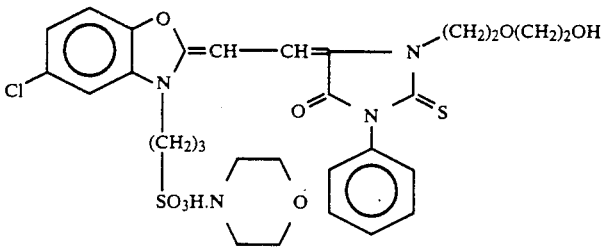

-continued
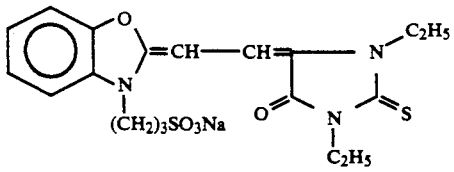
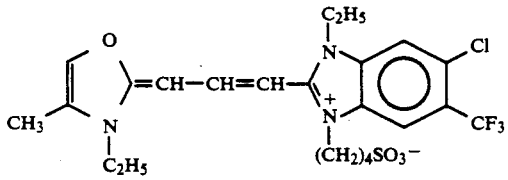
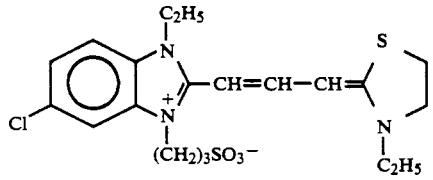
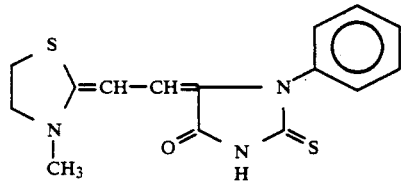
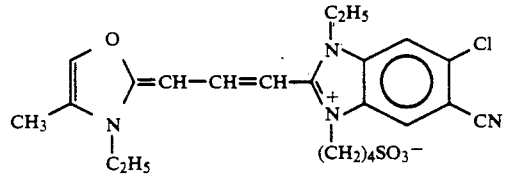
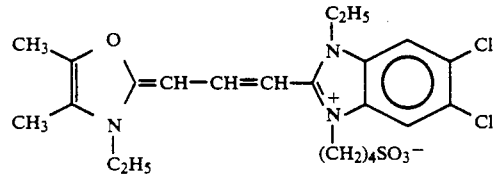
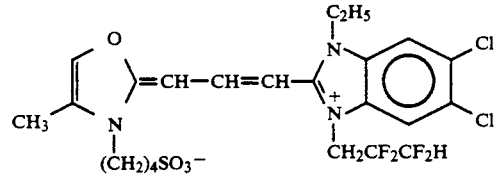
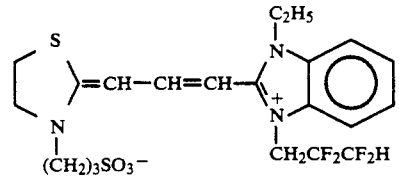
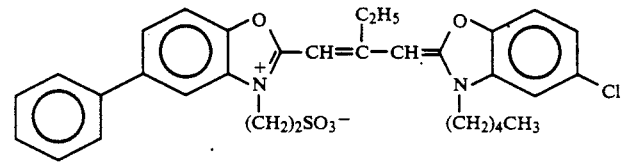

-continued

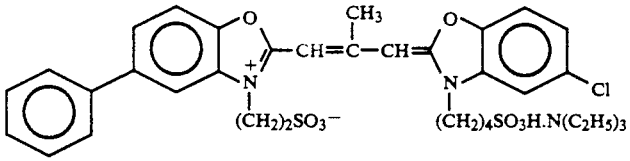

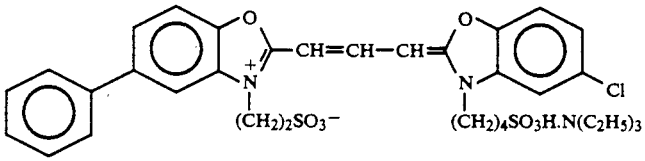

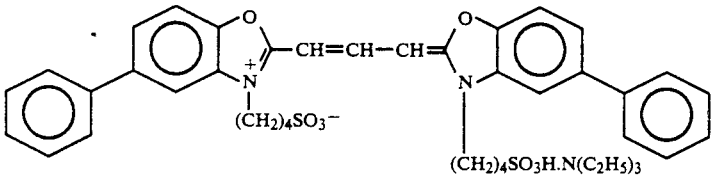

The yellow filter as used in the color photographic light-sensitive material according to the present invention can be colloidal silver usually used. It is also possible to use a yellow colored magenta coupler and/or a yellow nondiffusible organic dye instead of the colloidal silver particles.

The yellow colored magenta coupler which can be used in this invention can be those known in the art and particularly preferred are those listed below:

YD-1

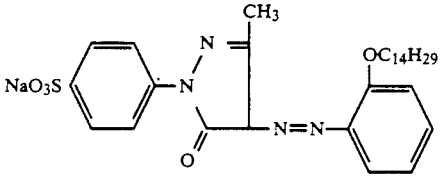

YD-2

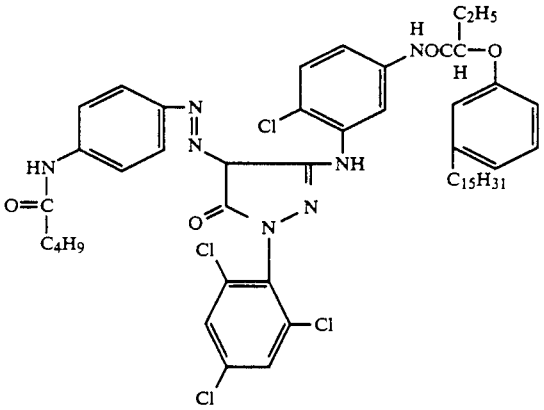

YD-3

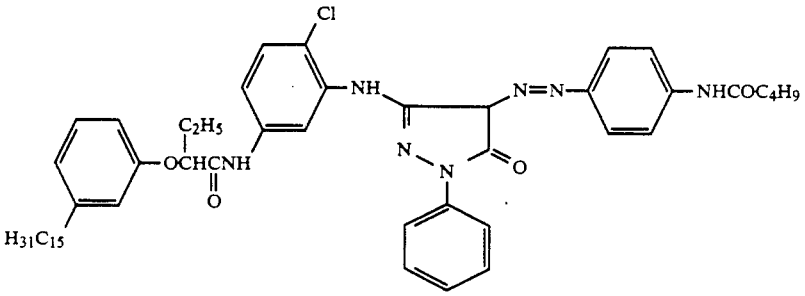

The incorporation of the yellow colored magenta coupler mentioned above into the yellow filter as used herein may, in general, be carried out according to a known process for incorporating a coupler into a silver halide emulsion layer, for instance, the process disclosed in U.S. Pat. No. 2,322,027, etc. For example, the yellow colored magenta coupler can be incorporated into the yellow filter, such as a hydrophilic colloidal silver by dissolving it into a suitable solvent and then adding the solution to the hydrophilic colloidal silver to obtain a dispersion. The suitable solvents include, for instance, alkyl phthalates such as dibutyl phthalate, dioctyl phthalate,; phosphoric esters such as diphenyl phosphate, triphenyl phosphate, tricresyl phosphate, dioctylbutyl phosphate; citrates such as tributyl acetylcitrate; benzoates such as octyl benzoate; alkylamides such as diethyllaurylamide; esters of fatty acid such as dibutoxyethyl succinate, dioctyl azelate; esters of trimesic acid such as tributyl trimesate; or organic solvents having a boiling point (B.P.) of from about 30° to 150° C., for instance, lower alkyl acetates such as ethyl acetate, butyl acetate; ethyl propionate, sec-butyl alcohol, methylisobutyl ketone, β-ethoxyethyl acetate, methyl cellosolve acetate. A mixture of an organic solvent having a high boiling point such as listed above and that having a low boiling point can also be used in the procedure mentioned above. Moreover, a method such as disclosed in Japanese Patent Publn. No. 51-39853 and Japanese Patent Appln. (OPI) No. 51-59943 in which a polymeric material is used to disperse the coupler in the colloidal silver can be used herein.

When the yellow colored magenta coupler includes acid groups such as carboxyl group and sulfonyl group, the coupler is incorporated into the hydrophilic colloid in the form of an alkaline aqueous solution.

The yellow nondiffusible organic dye which can be used in the present invention can be selected from the group consisting of any known such dyes and particularly preferred are those described below:

YD-4

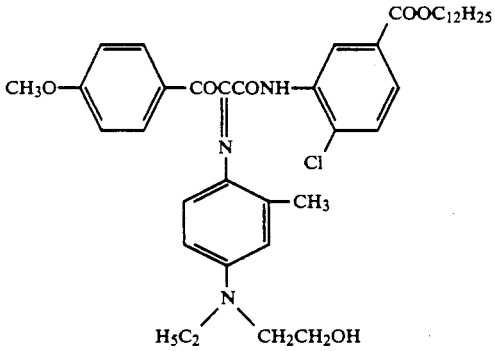

YD-5

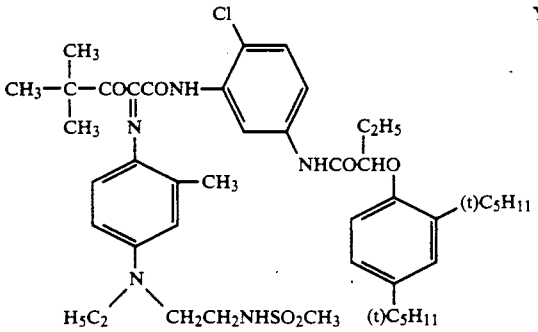

-continued

YD-6

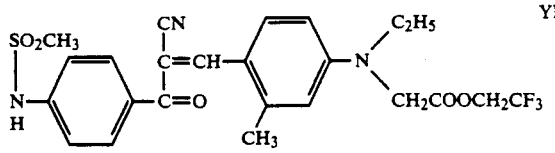

YD-7

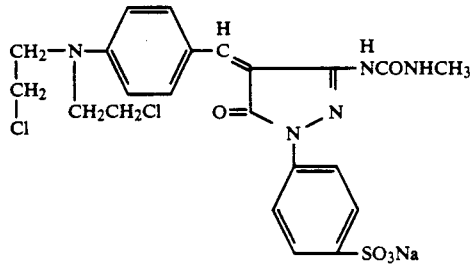

YD-8

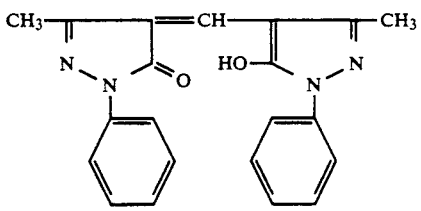

YD-9

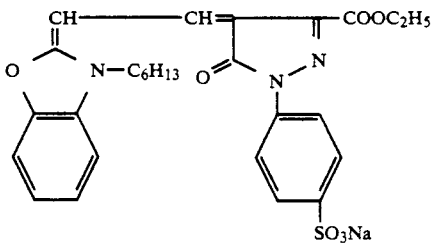

YD-10

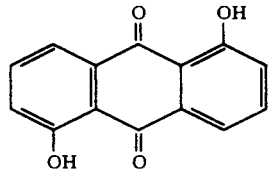

YD-11

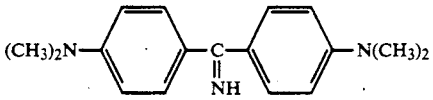

YD-12

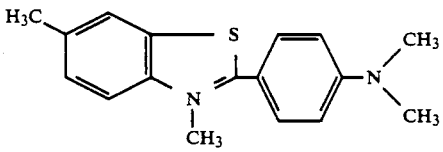

YD-13

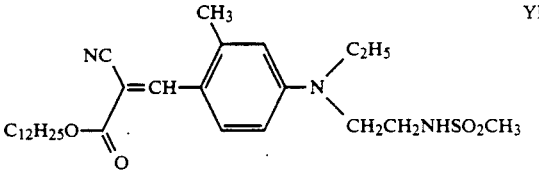

-continued

YD-14

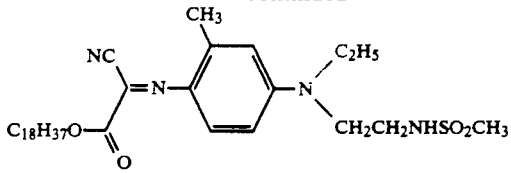

The yellow filter including an organic dye which is used herein can be prepared according to a conventional method. In this respect, if the organic dye used is oil-soluble, the yellow filter is prepared by a method similar to that for introducing a yellow colored magenta coupler into a hydrophilic colloidal silver as already explained above, while if the dye is water-soluble, it is incorporated into a hydrophilic colloid as an aqueous or alkaline aqueous solution thereof. In addition, the yellow filter layer of the present invention is prepared according to a method similar to those used to form a colloidal silver layer and the amounts of the colloidal silver, the yellow colored magenta coupler and the organic dye used can be controlled so as to obtain a desired optical density.

In the present invention, a variety of color couplers can be used and concrete examples thereof are disclosed in patents listed in Research Disclosure No. 17643, VII-C–G mentioned above. Important dye-forming couplers are those which give three primary colors of the subtractive process (i.e., yellow, magenta and cyan) upon development and concrete examples of nondiffusible four or two equivalent coupler are disclosed in the Patents cited in research Disclosure No. 176743, VII-C and D as cited above and further the following couplers can preferably be used herein:

A typical yellow coupler capable of being used in the present invention is a hydrophobic acylacetamide type coupler having a ballast group. Examples of a such coupler are disclosed in U.S. Pat. Nos. 2,407,210; 2,875,057; and 3,265,506. 2-Equivalent yellow couplers are preferably used in the present invention. Typical examples thereof are the yellow couplers of an oxygen atom splitting-off type described in U.S. Pat. Nos. 3,408,194; 3,447,928; 3,933,501; and 4,022,620, or the yellow couplers of a nitrogen atom splitting-off type described in Japanese Patent Publication No. 10739/1983, U.S. Pat. Nos. 4,401,752 and 4,326,024, research Disclosure (RD) No. 18053 (April, 1979), UK Patent 1,425,020, DEOS Nos. 2,219,917; 2,261,361; 2,329,587; and 2,433,812. α-Pivaloyl acetanilide type couplers are excellent in fastness, particularly light fastness, of formed dye. α-Benzoyl acetanilide type couplers provide a high color density.

Magenta couplers which may be used in the present invention other than the afore-mentioned 2-equivalent magenta polymer couplers include hydrophobic couplers having a ballast group of indazolone, cyanoacetyl, or, preferably, pyrazoloazole and 5-pyrazolone. Among 5-pyrazolone type couplers, couplers whose 3-position is substituted with an arylamino or acylamino group is preferred from the viewpoint of color hue and color density of the formed dye. Typical examples thereof are described in U.S. Pat. Nos. 2,311,082; 2,343,703; 2,600,788; 2,908,573; 3,062,653; 3,152,896; and 3,936,015. A splitting-off group of the 2-equivalent 5-pyrazolone type couplers is preferably a nitrogen atom splitting-off group described in U.S. Pat. No. 4,310,619 and an arythio group described in U.S. Pat. No. 4,351,897. The 5-pyrazolone type coupler having ballast groups described in European Patent No. 73,636 yields a high color density.

As examples of pyrazoloazole type couplers, there are named pyrazologenzimidazoles described in U.S. Pat. No. 3,061,432, preferably pyrazolo [5, 1-c] [1, 2, 4] triazoles described in U.S. Pat. No. 3,725,067, pyrazolotetrazols described in Research Disclosure No. 24220 (June 1984) and Japanese Patent Appln. (OPI) No. 33552/1985, and pyrazolopyrazoles described in Research Disclosure No. 24230 (June, 1984) and Japanese Patent Publication No. 43659/1985. Imidazo [1, 2-b] pyrazoles described in U.S. Pat. No. 4,500,630 is preferred on account of small yellow minor absorption of formed dye. Pyrazols [1, 5-b] [1, 2, 4] triazole described in U.S. Pat. No. 4,540,654 is particularly preferred.

Cyan couplers which may be used in the present invention include naphthol or phenol type couplers having a hydrophobic and nondiffusing properties. Typical naphthol type couplers are described in U.S. Pat. No. 2,474,293. Typical 2-equivalent naphthol type couplers of oxygen atom splitting-off type are described in U.S. Pat. Nos. 4,052,212; 4,146,396; 4,228,233; and 4,296,200. Exemplary phenol type couplers are described in U.S. Pat. Nos. 2,369,929; 2,801,171; 2,772,162; and 2,895,826.

Cyan couplers which can form dyes resistant to humidity and heat are preferably used in the present invention. Typical examples thereof are phenol type cyan couplers having an alkyl group including at least two carbon atoms at a metha-position of a phenolic nucleus as described in U.S. Pat. No. 3,772,002; 2,5-diacylamino-substituted phenol type couplers as described in U.S. Pat. Nos. 2,772,162; 3,758,308; 4,126,396; 4,334,011; and 4,327,173; DEOS No. 3,329,729; and European Patent No. 121,365; and phenol type couplers having a phenylureido group at the 2-position and an acylamino group at the 5-position as described in U.S. Pat. Nos. 3,446,622; 4,333,999; 4,451,559; and 4,427,767. Cyan couplers in which the 5-position of naphthol is substituted with a substituent such as sulfonamide, carboxylic acid amide group as described in Japanese Patent Applns. (OPI) No. 60-237448/1985, Japanese Patent Applications 264277/1984 and 268135/1984 are excellent in fastness of formed image and may also be preferably used in the present invention.

In order to compensate unnecessary absorption of dye formed, it is preferred to effect masking with the use of a colored coupler together in color light-sensitive materials used for taking photographs. Typical examples thereof are the yellow colored magenta coupler described in U.S. Pat. No. 4,163,670 and Japanese Patent Publication No. 39413/1982, the magenta colored cyan coupler described in U.S. Pat. Nos. 4,004,929 and 4,138,258, and UK Patent No. 1,146,368. Other colored couplers disclosed in the above mentioned Research Disclosure No. 17643, VII-G may also be used herein.

The couplers for masking to eliminate undesired absorption include compounds having a group which serves as a splitting-off group and is capable of coordinating with a metal to make color, as disclosed in U.S. Pat. Nos. 4,555,477 and 4,555,478. These couplers are colorless before coupling with an oxidant of the developing agent, while, after development, the exposed portion presents the hue of the dye formed due to coupling after the released ligands coordinated with the metal are washed away, on the other hand the non-exposed portion develops color as a result of the coordination of ligands fixed to the coupler with metal ions such as Fe(II) ions contained in the processing liquid. As a result, the reduction in sensitivity due to the filter effect of the formed colored coupler is extremely restricted and thus these couplers can preferably be used in the present invention. The light-sensitive material containing such a coupler may be treated in accordance with a usual development process or may also be treated with a process which comprises a step for treating in a new specific bath containing metal ions. Examples of such metal ions include Fe(II), Co(II), Cu(I), Cu(II), Ru(II) ions and particularly preferred are F(II) ions.

Graininess may be improved by using together a coupler whose chromophoric dye is highly diffusible. As such couplers, some magenta couplers are specifically described in U.S. Pat. No. 4,366,237 and UK Patent No. 2,125,570 and some yellow, magenta and cyan couplers are specifically described in European Patent No. 96,570 and DEOS No. 3,234,533.

Dye-forming couplers and the aforesaid special couplers may be a dimer or a higher polymer. Typical examples of polymerized dye-forming couplers are described in U.S. Pat. Nos. 3,451,820 and 4,080,211. Examples of polymerized magenta couplers are described in UK Patent No. 2,102,173, U.S. Pat. No. 4,367,282, Japanese Patent Appln. Nos. 75041/1985 and 113596/1985.

The couplers which release a photographically useful group upon the coupling reaction may preferably be used in the present invention. Useful DIR couplers releasing a development inhibitor are disclosed in Patents listed in the above cited Research Disclosure No. 17643, VII-F.

Among the aforesaid DIR couplers, couplers which are preferably used in combination with the coupler according to the invention are DIR couplers which release development inhibiting moieties which is deactivated in a developing solution as described in Japanese Patent Application (OPI) No. 151944/1982, timing DIR couplers as described in U.S. Pat. No. 4,248,962 and Japanese Patent Application (OPI) No. 39653/1984 and reaction type couplers as described in Japanese Patent Application (OPI) No. 184248/1985. Particularly preferred ones are the developing solution deactivation type DIR couplers described in Japanese Patent Application (OPI) Nos. 151944/1982, 217932/1983, 218644/1985, 225156/1985, and 233650/1985, and the reaction type DIR couplers described in Japanese Patent Application (OPI) No. 184248/1985.

The light-sensitive materials of the present invention may contain a compound which releases a nucleus-forming agent or a development accelerator or a precursor thereof (hereinafter referred to as a development accelerator) in a form of image during development. Examples of such compounds are described in UK Patent Nos. 2,097,140 and 2,131,188. Particularly preferred are couplers releasing a nucleating agent or the like which exert an adsorbing effect on silver halide. Examples thereof are those disclosed in, for instance, Japanese Patent Application (OPI) Nos. 59-157638 and 59-170840.

Supports which can suitably be used in the present invention are disclosed in, for example, the above cited Research Disclosure No. 17643, p 28 and ibid, No. 18716, pp 647 (right-hand column) to 648 (left-hand column).

The color photographic light-sensitive material can be developed according to any one of usual methods such as those disclosed in the above cited Research Disclosure No. 17643, pp 28–29 and ibid, No. 18716, pp 651 (right-hand column to left-hand column).

The color photographic light-sensitive materials are, in general, subjected to water washing or stabilization treatment after development, bleach-fix or fixing process.

The water washing process is usually carried out by using at least two washing baths and washing in a counterflow manner to save the amount of washing water. The stabilization process which may be carried out instead of the washing process can typically be effected according to a multi-step counterflow method as disclosed in Japanese Patent Application (OPI) No. 57-8543. In this step, it is required to use 2 to 9 counterflow baths. The stabilization bath can contain different kinds of compounds to stabilize images. For example, various kinds of buffering agents for adjusting pH of the membrane (e.g., pH 3 to 8), such as a combination of borate, metaborate, borax, phosphates, carbonates, potassium hydroxide, sodium hydroxide, aqueous ammonia, monocarboxylic acids, dicarboxylic acids and polycarboxylic acids; and aldehydes such as formalin may be used. Moreover, softening agents such as inorganic phosphoric acids, aminopolycarboxylic acids, organic phosphoric acids, amino-polyphosphonic acids, phosphonocarboxylic acids; bactericides or/and fungicides such as benzoisothiazolinones, isothiazolones, 4-thiazolin benzimidazoles, halogenated phenols; surfactants; fluorescent whiteners; hardening agents or the like may also be used in the stabilization bath. The combination of two or more of these compounds may be used for the same or different purposes.

Furthermore, preferred examples of the pH adjustor for membrane after treatment include a variety of ammonium salts such as ammonium chloride, ammonium nitrate, ammonium sulfate, ammonium phosphate, ammonium sulfite, ammonium thiosulfate.

The present invention can be applied to different kinds of color light-sensitive materials. Typical examples of such materials include color negative filters for motion picture and popular use; color reversal filters for slides or television; and color reversal papers for directly taking photographs. This invention may also be applied to monochrome light-sensitive materials utilizing three-color coupler mixing as disclosed in Research Disclosure No. 17123 (July, 1978).

Moreover, the present invention may be applied to light-sensitive materials of heat development type or high temperature development type such as those disclosed in U.S. Pat. No. 4,500,626, Japanese Patent Appln. (OPI) Nos. 60-133449 and 59-218443 and Japanese Patent Appln. Serial No. 60-79709.

The present invention will further be explained in more detail with reference to the following examples:

EXAMPLE 1 a) Preparation of Comparative Sample:

a)-1 SAMPLE 101: Comparative sample; the light-sensitive material having a spectral sensitivity distribution similar to that disclosed in U.S. Pat. No. 3,672,898 and a low interlayer effect.

On a cellulose triacetate film support having an undercoating, there was formed a multilayer color light-sensitive material (SAMPLE 101) consisting of the layers having the following compositions respectively.

(Composition of each Light-Sensitive Layer)

The amounts of silver halide and colloidal silver coated are expressed in grams of silver per square meter, those of the couplers, additives and gelatin are expressed in grams thereof per square meter and those of the sensitizing dyes are expressed in moles thereof per mole of silver halide included in the same layer.

| | |
|---|---|
| 1st Layer (Antihalation Layer) | |
| Black Colloidal Silver | 0.2 |
| Gelatin | 1.3 |
| Colored Coupler C-1 | 0.06 |
| UV Absorber UV-1 | 0.1 |
| UV Absorber UV-2 | 0.2 |
| Dispersion Oil-1 | 0.01 |
| Dispersion Oil-2 | 0.01 |
| 2nd Layer (Intermediate Layer) | |
| Finely Divided Silver Bromide (Average Grain Size: 0.07μ) | 0.15 |
| Gelatin | 0.1 |
| Colored Coupler C-2 | 0.02 |
| Dispersion Oil-1 | 0.1 |
| 3rd Layer (First Red-Sensitive Emulsion Layer) | |
| Silver Iodobromide Emulsion (AgI Content: 2 mole %; Average Grain Size: 0.3μ) | 0.3 |
| Gelatin | 0.6 |
| Sensitizing Dye I | $4.0 \times 10^{-4}$ |
| Coupler C-3 | 0.06 |
| Coupler C-4 | 0.06 |
| Coupler C-5 | 0.01 |
| Coupler C-8 | 0.04 |
| Coupler C-2 | 0.03 |
| Dispersion Oil-1 | 0.03 |
| Dispersion Oil-3 | 0.012 |
| 4th Layer (Second Red-Sensitive Emulsion Layer) | |
| Silver Iodobromide Emulsion (AgI Content: 5 mole %; Average Grain Size: 0.5μ) | 0.5 |
| Sensitizing Dye I | $4 \times 10^{-4}$ |
| Coupler C-3 | 0.24 |
| Coupler C-5 | 0.02 |
| Coupler C-4 | 0.24 |
| Coupler C-8 | 0.04 |
| Coupler C-2 | 0.04 |
| Dispersion Oil-1 | 0.15 |
| Dispersion Oil-3 | 0.02 |
| 5th Layer (Third Red-Sensitive Emulsion Layer) | |
| Silver Iodobromide Emulsion (AgI Content: 10 mole %; Average Grain Size: 0.7μ) | 1.0 |
| Gelatin | 1.0 |
| Sensitizing Dye I | $4 \times 10^{-4}$ |
| Coupler C-6 | 0.05 |
| Coupler C-7 | 0.1 |
| Dispersion Oil-1 | 0.01 |
| Dispersion Oil-2 | 0.05 |
| 6th Layer (Intermediate Layer) | |
| Gelatin | 0.1 |
| Compound Cpd-A | 0.03 |
| Dispersion Oil-1 | 0.05 |
| 7th Layer (First Green-Sensitive Emulsion Layer) | |
| Silver Iodobromide Emulsion (AgI Content: 4 mole %; Average Grain Size: 0.3μ) | 0.15 |
| Sensitizing Dye II | $3 \times 10^{-4}$ |
| Sensitizing Dye III | $3 \times 10^{-4}$ |
| Sensitizing Dye IV | $1 \times 10^{-4}$ |
| Gelatin | 1.0 |
| Coupler C-9 | 0.2 |
| Coupler C-1 | 0.03 |

-continued

| | |
|---|---|
| Dispersion Oil-1 | 0.5 |
| 8th Layer (Second Green-Sensitive Emulsion Layer) | |
| Silver Iodobromide Emulsion (AgI Content: 5 mole %; Average Grain Size: 0.5μ) | 0.15 |
| Sensitizing Dye II | $2 \times 10^{-4}$ |
| Sensitizing Dye III | $2 \times 10^{-4}$ |
| Sensitizing Dye IV | $0.6 \times 10^{-4}$ |
| Coupler C-9 | 0.25 |
| Coupler C-1 | 0.03 |
| Coupler C-10 | 0.015 |
| Dispersion Oil-1 | 0.2 |
| 9th Layer (Third Green-Sensitive Emulsion Layer) | |
| Silver Iodobromide Emulsion (AgI Content: 6 mole %; Average Grain Size: 0.7μ) | 0.3 |
| Gelatin | 1.0 |
| Sensitizing Dye II | $1.5 \times 10^{-4}$ |
| Sensitizing Dye III | $1.5 \times 10^{-4}$ |
| Sensitizing Dye IV | $0.5 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |
| Dispersion Oil-1 | 0.20 |
| Dispersion Oil-2 | 0.05 |
| 10th Layer (Yellow Filter Layer) | |
| Gelatin | 1.2 |
| Yellow Colloidal Silver | 0.04 |
| Compound Cpd-B | 0.1 |
| Dispersion Oil-1 | 0.3 |
| 11th Layer (First Blue-Sensitive Emulsion Layer) | |
| Monodisperse Silver Iodobromide Emulsion Layer (AgI Content: 4 mole %; Average Grain Size: 0.3μ) | 0.3 |
| Gelatin | 1.0 |
| Sensitizing Dye V | $2 \times 10^{-4}$ |
| Coupler C-3 | 0.01 |
| Coupler C-14 | 0.9 |
| Coupler C-5 | 0.02 |
| Dispersion Oil-1 | 0.2 |
| 12th Layer (Second Blue-Sensitive Emulsion Layer) | |
| Silver Iodobromide (Average grain size: 1.5μ; AgI Content: 10 mole %) | 0.5 |
| Gelatin | 0.6 |
| Sensitizing Dye V | $1 \times 10^{-4}$ |
| Coupler C-14 | 0.25 |
| Dispersion Oil-1 | 0.07 |
| 13th Layer (First Protective Layer) | |
| Gelatin | 0.8 |
| UV Absorber UV-1 | 0.1 |
| UV Absorber UV-2 | 0.2 |
| Dispersion Oil-1 | 0.01 |
| Dispersion Oil-2 | 0.01 |
| 14th Layer (Second Protective Layer) | |
| Fine Silver Bromide Grains (Average Grain Size: 0.07μ) | 0.5 |
| Gelatin | 0.45 |
| Polymethylmethacrylate Particles (Diameter: 1.5μ) | 0.2 |
| Hardening Agent H-1 | 0.4 |
| Formaldehyde Scavenger S-1 | 0.5 |
| Formaldehyde Scavenger S-2 | 0.5 |

In addition to the above constituents, a surfactant was used as a coating aid in each layer. The sample thus prepared was named as SAMPLE 101.

The chemical structures and names of the compounds used in the example are listed below:

UV-1
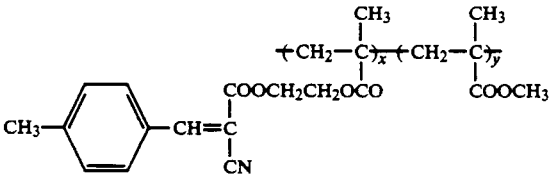
x/y = 7/3 (Weight ratio)
UV-2
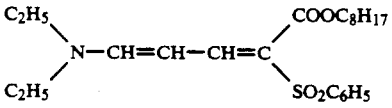
Tricresyl Phosphate — Oil-1
Dibutyl Phthalate — Oil-2
Bis (2-Ethylhexyl) Phthalate — Oil-3
C-1
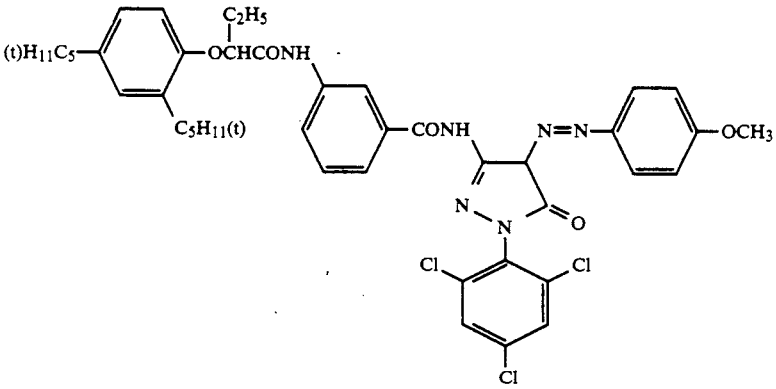
C-2
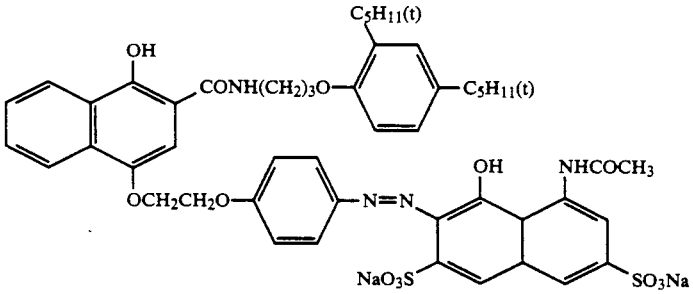
C-3
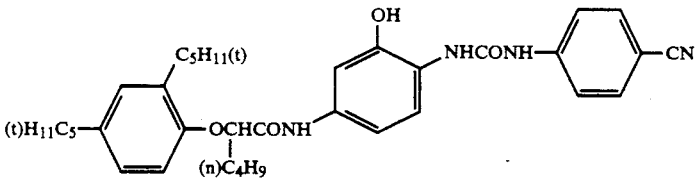
C-4
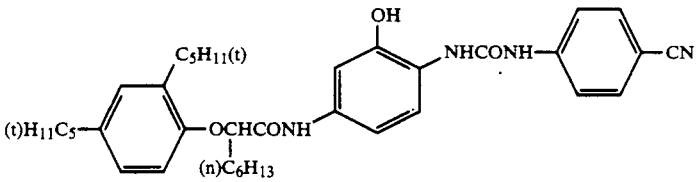

-continued
C-5
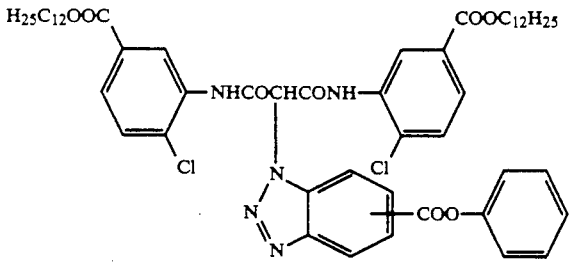
C-6
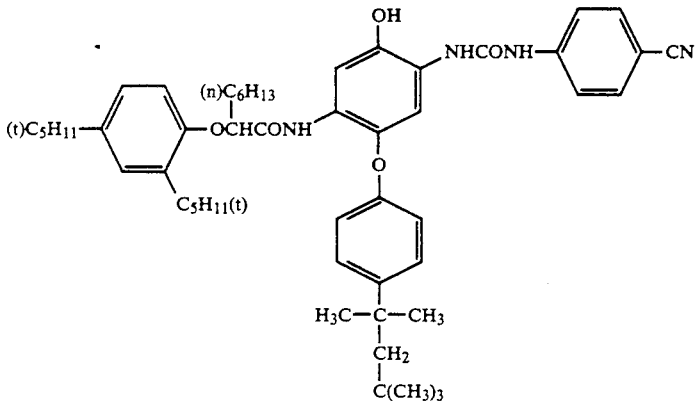
C-7
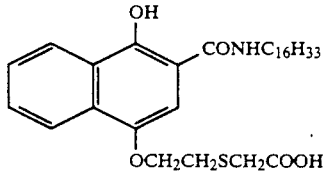
C-8
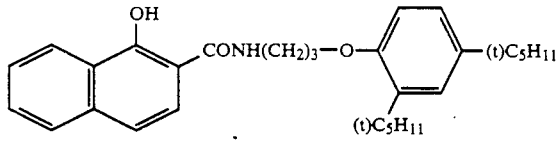
C-9
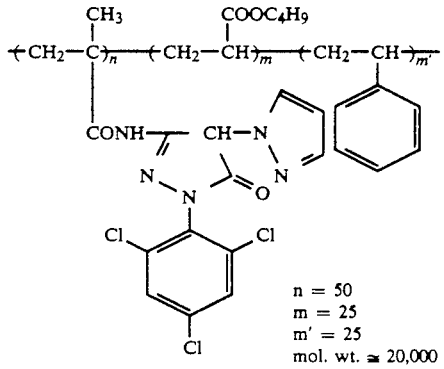

-continued
C-10
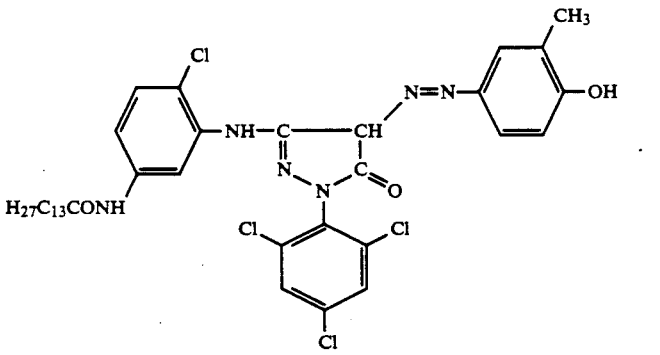
C-11
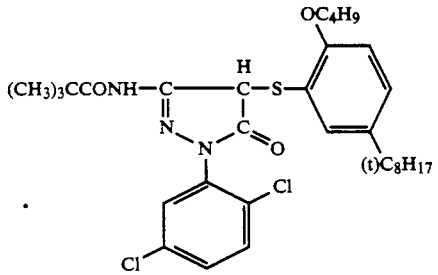
C-12
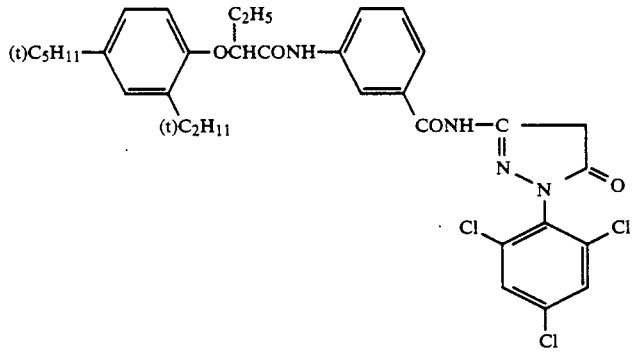
C-13
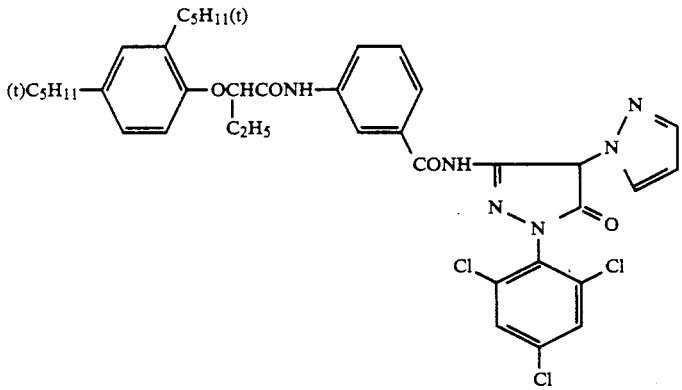
C-14
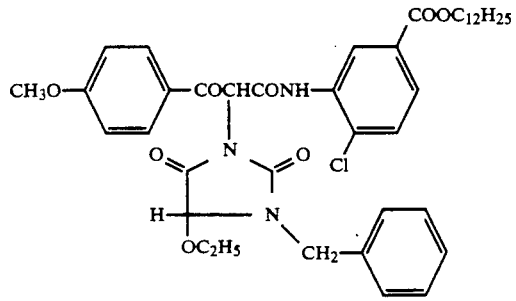

-continued
C-15
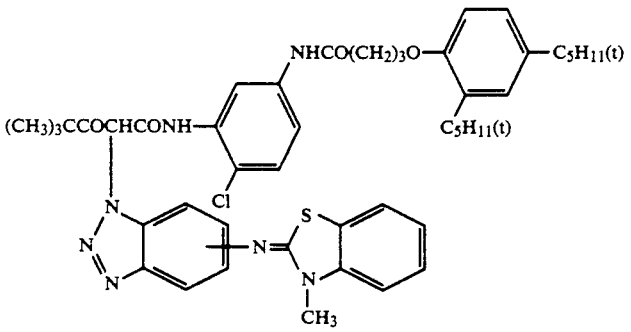
Sensitizing Dye I
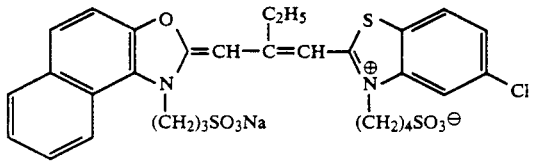
Sensitizing Dye II
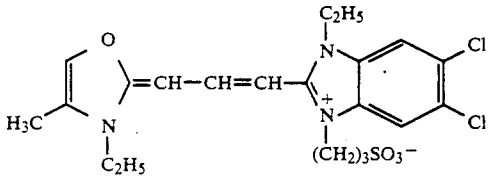
Sensitizing Dye III
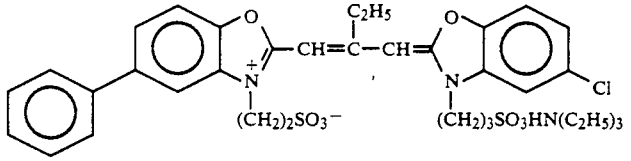
Sensitizing Dye IV
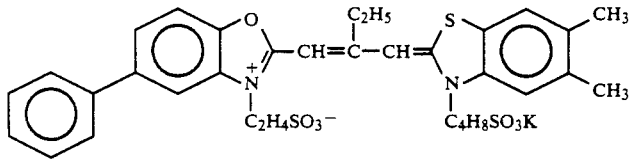
Sensitizing Dye V
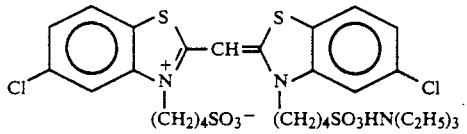
H-1
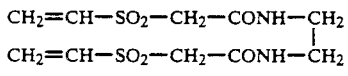
S-1
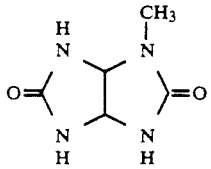
Y-1
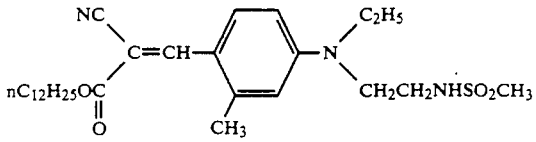

-continued

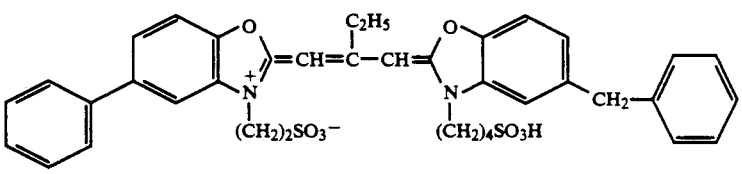

S-6

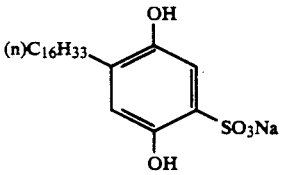

Cpd A

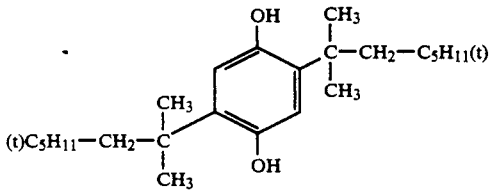

Cpd B a)-2 Preparation of SAMPLE 102

In order to increase the saturation of the reproduced color, SAMPLE 102, the green-sensitive layer of which comprises a DIR coupler, was prepared SAMPLE 102 (Comparative Sample)

SAMPLE 101 was modified as follows to prepare SAMPLE 102:

(i) DIR coupler C-5 was added to the 7th layer in an amount of 0.03 g/m$^2$ and the coated amount thereof was increased to 1.5 times layer than that of SAMPLE 101;

(ii) DIR coupler C-5 was added to the 8th layer in an amount of 0.01 g/m$^2$ and the coated amount thereof was increased to 1.3 times larger than that of SAMPLE 101;

(iii) The coated amounts of the 3rd and 4th layers were increased to 1.3 times larger than that of SAMPLE 101, respectively;

(iv) The coated amount of the 11th layer was increased to 1.1 times larger than that of SAMPLE 101.

The resulting photographic element was exposed to light of a tungsten lamp through an optical wedge, while adjusting color temperature to 4,800° K. using a filter, followed by color development which was carried out at 38° C. according to the procedures described below and then subjected to sensitometry.

| | |
|---|---|
| Color Development | 3 min. 15 sec. |
| Bleaching | 6 min. 30 sec. |
| Water Washing | 2 min. 10 sec. |
| Fixing | 4 min. 20 sec. |
| Water Washing | 3 min. 15 sec. |
| Stabilization | 1 min. 05 sec. |

The compositions of processing liquids used in these procedures were as follows:

| | |
|---|---|
| Color development solution | |
| diethylene triamine pentaacetatic acid | 1.0 g |
| 1-hydroxyethylidene-1,1-diphosphonic acid | 2.0 g |
| sodium sulfite | 4.0 g |
| potassium carbonate | 30.0 g |
| potassium bromide | 1.4 g |

-continued

| | |
|---|---|
| potassium iodide | 1.3 mg |
| hydroxylamine sulfate | 2.4 g |
| 4-(N-ethyl-N-β-hydroxyethyl-amino)-2-methyl aniline sulfate | 4.5 g |
| water | to 1.0 l |
| pH | 10.0 |
| Bleaching solution | |
| ferric ammonium ethylenediamine tetraacetate | 100.0 g |
| disodium ethylendiamine-tetraacetate | 10.0 g |
| ammonium bromide | 150.0 g |
| ammonium nitrate | 10.0 g |
| water | to 1.0 l |
| pH | 6.0 |
| Fixing solution | |
| disodium ethylenediamine-tetraacetate | 1.0 g |
| sodium sulfite | 4.0 g |
| aqueous solution of ammonium thiosulfate (70%) | 175.0 ml |
| sodium hydrogen sulfite | 4.6 g |
| water | to 1.0 l |
| pH | 6.6 |
| Stabilization solution | |
| formalin (40%) | 2.0 ml |
| polyoxyethylene-p-monononylphenyl ether (average degree of polymerization: 10) | 0.3 g |
| water | to 1.0 l |

As a result, SAMPLE 102 gave approximately identical sensitivity and gradation with those of SAMPLE 101.

On the SAMPLES 101 and 102, the evaluation of the reproduction of spectra was carried out according to the procedures explained above. The results obtained are shown in FIGS. 4A and 4B.

Results

Figure 4A:
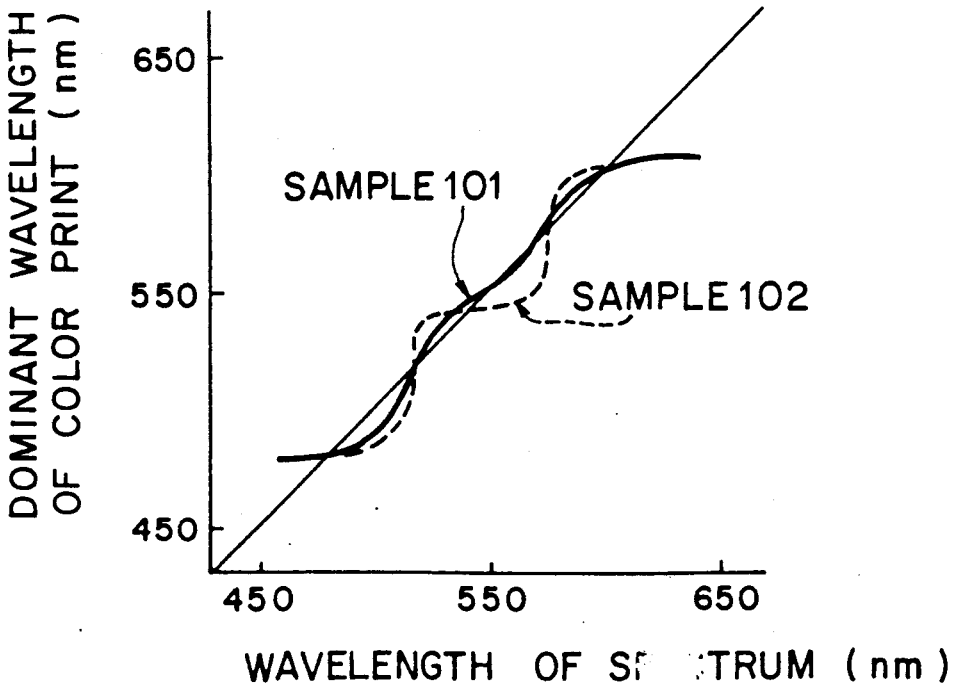
FIG. 4A, 6A to 6G and 9A to 9G show results of the color reproduction test on light-sensitive materials.

SAMPLE 101 has the dominant wavelength of the reproduced color which consists with that of the spectral light used to expose the same, as seen from FIG. 4A. However, it was found that the saturation of the reproduced color is extremely reduced according to the result shown in FIG. 4B.

Figure 4B:
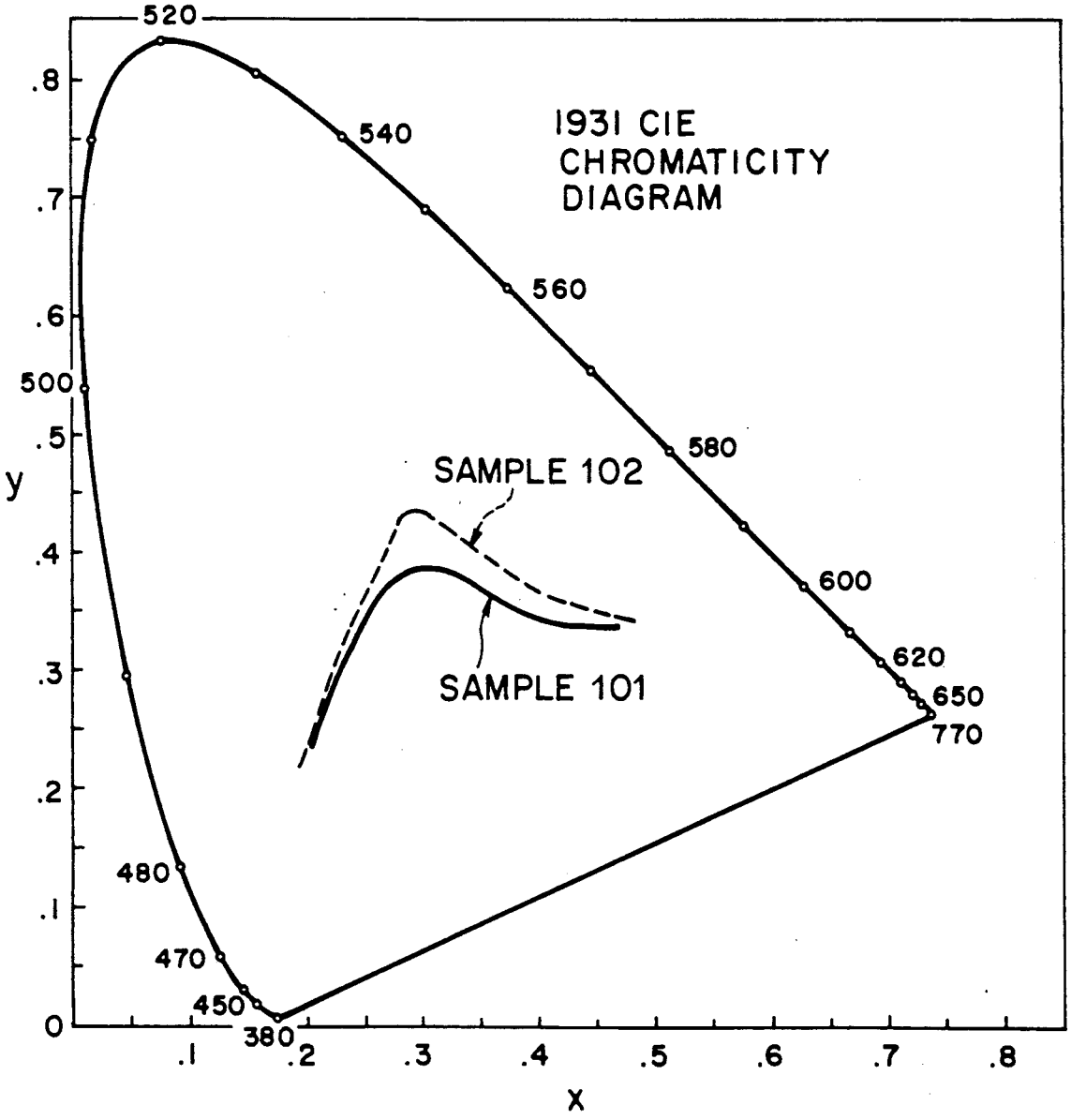
FIG. 4B shows the chromaticity locus of the samples 101 and 102.

While, as seen from FIG. 4B, SAMPLE 102 has an increased saturation compared with SAMPLE 101, on the contrary, the result shown in FIG. 4A shows that the reproduction of the spectral light is remarkably reduced.

Evaluation According to the Conventional Method

Figure 5:
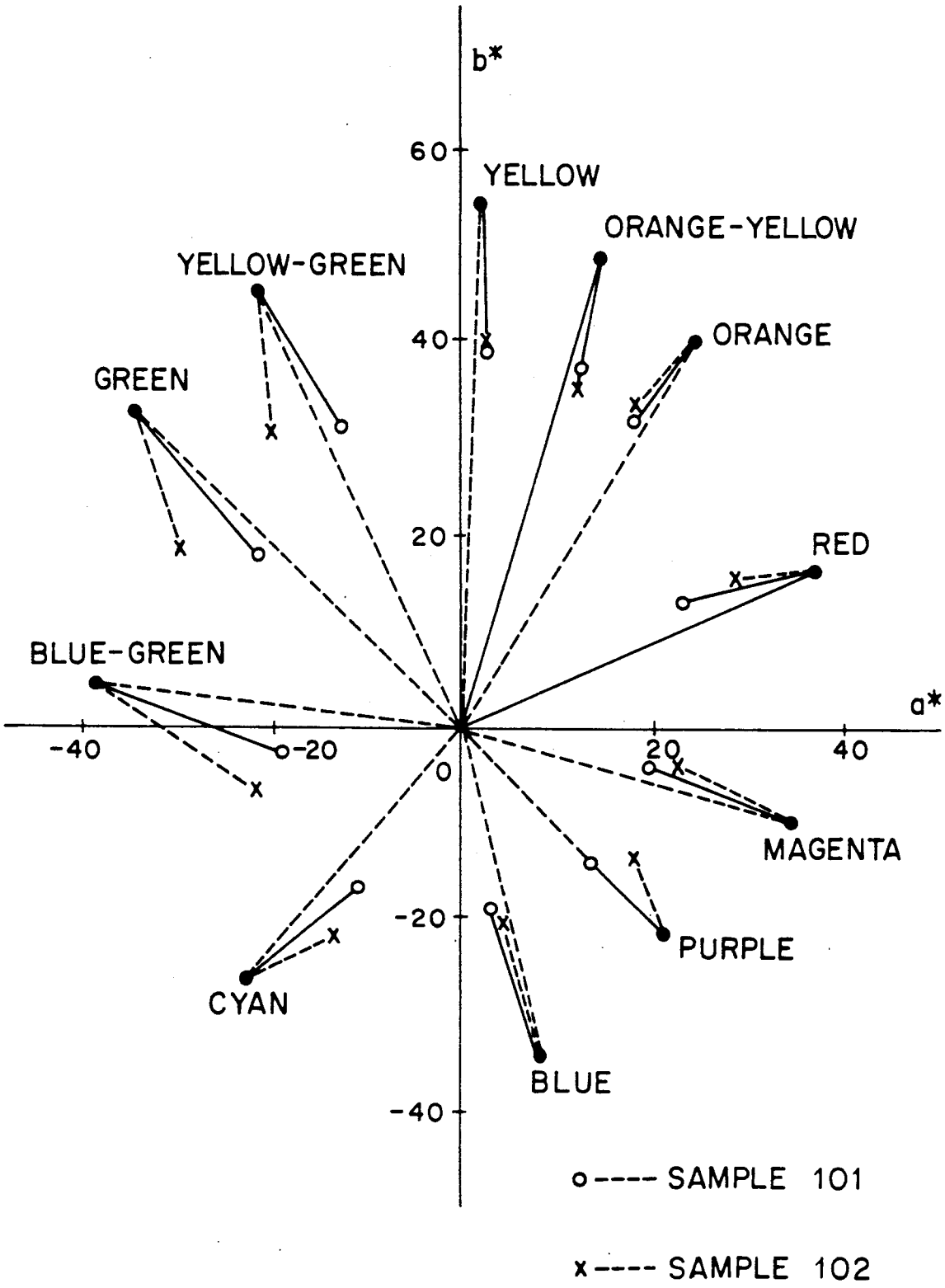
FIG. 5 shows Munsell color chip in which the filled circle (•) is the original of the color chip, the open circle (o) is that reproduced by the sample 101, the mark (x) is that of sample 102, these being plotted on the a*-b* coordinate, in this figure the more the reproduced color is distant from the origin, the more the color is clearer, and the hue is identical if the angles formed between each point and the origin is equal to that formed between the original (•) and the origin.
Figure 6A:
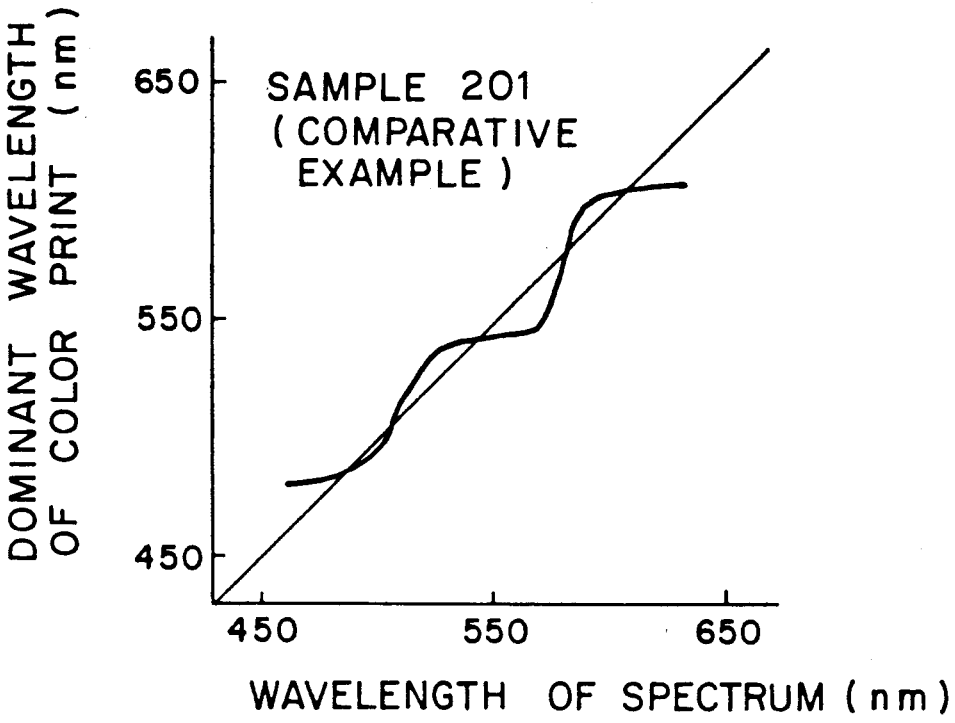
Figure 6B:
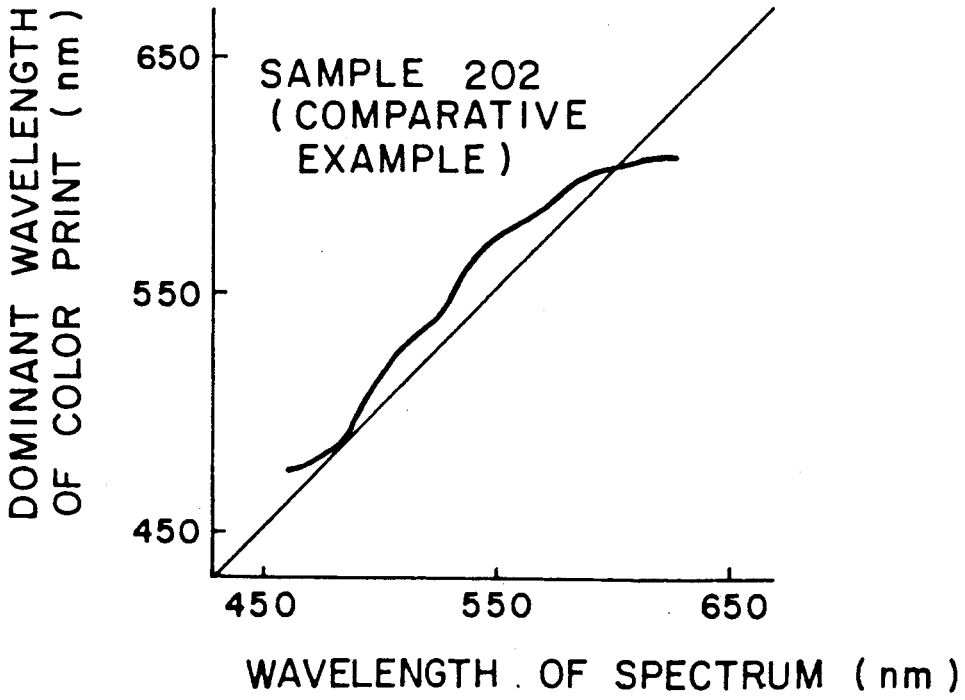
Figure 6C:
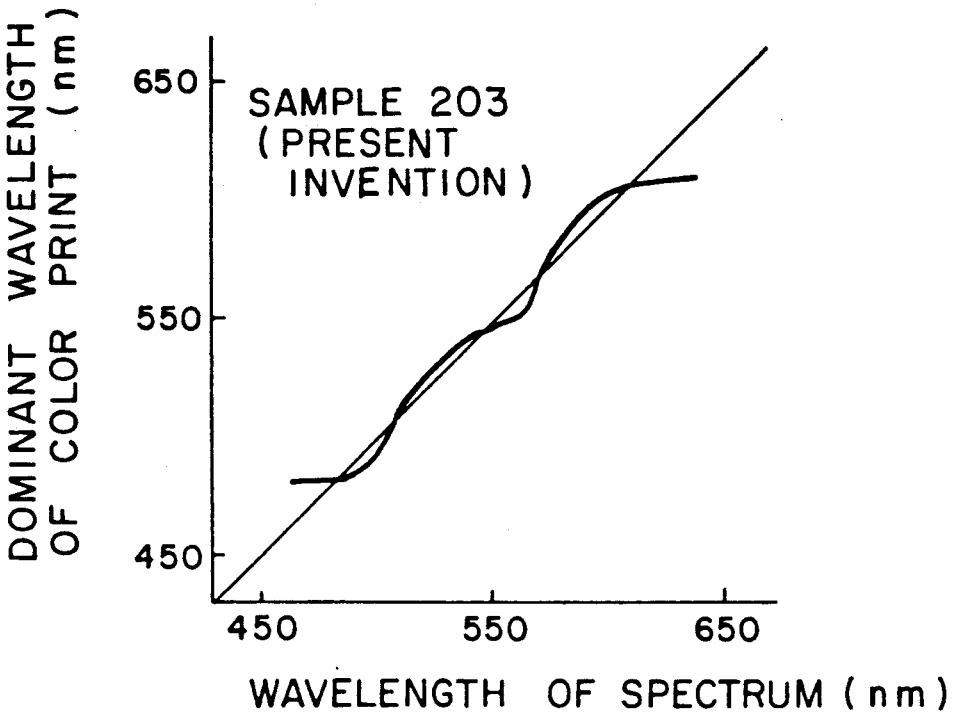
Figure 6D:
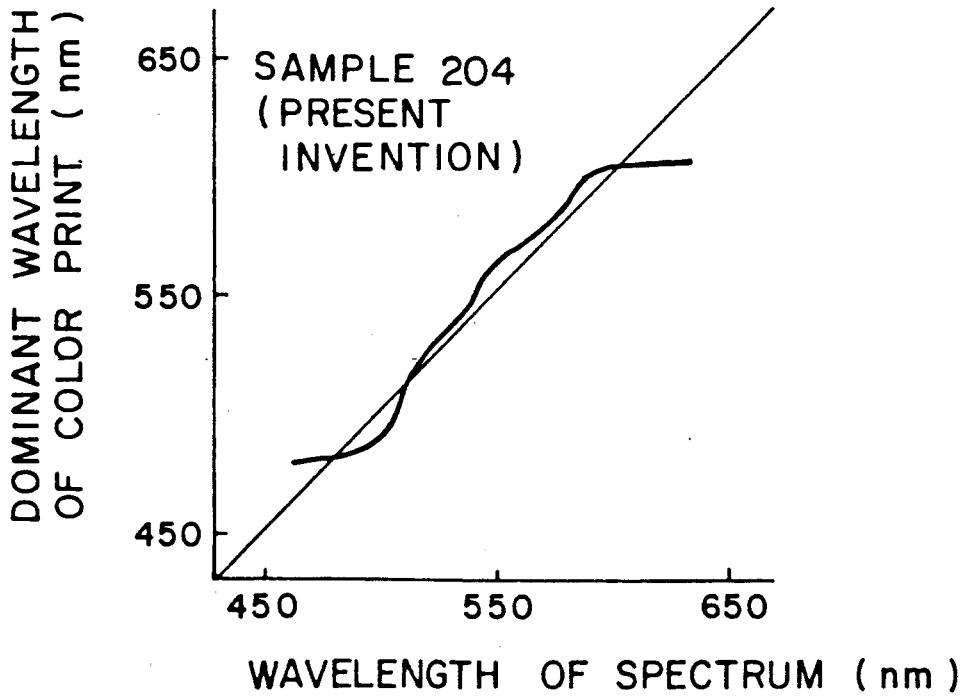
Figure 6E:
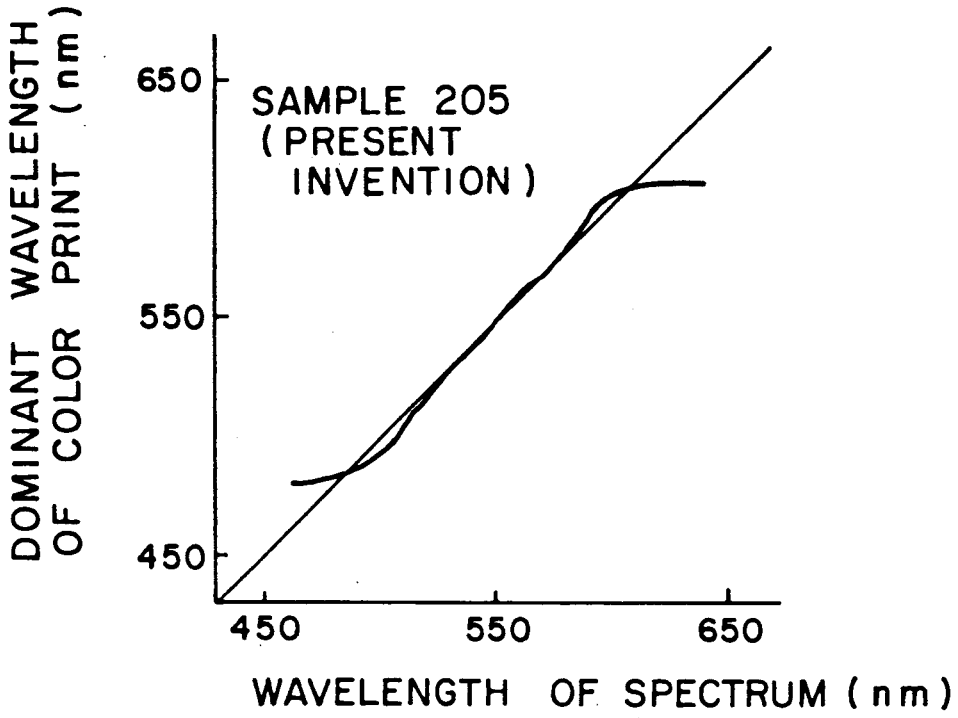
Figure 6F:
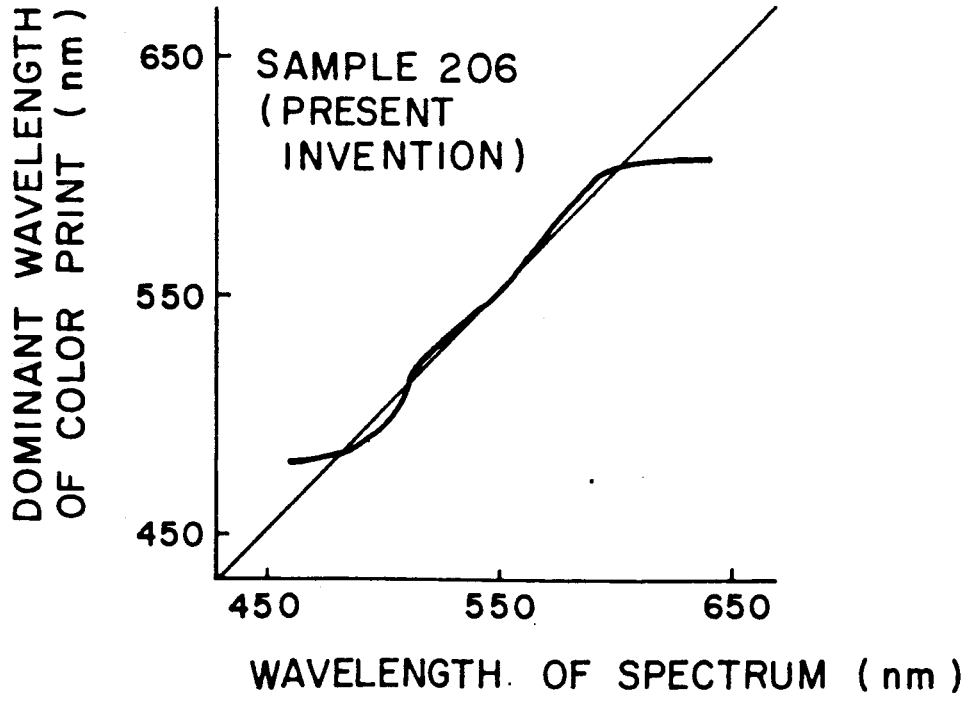
Figure 6G:
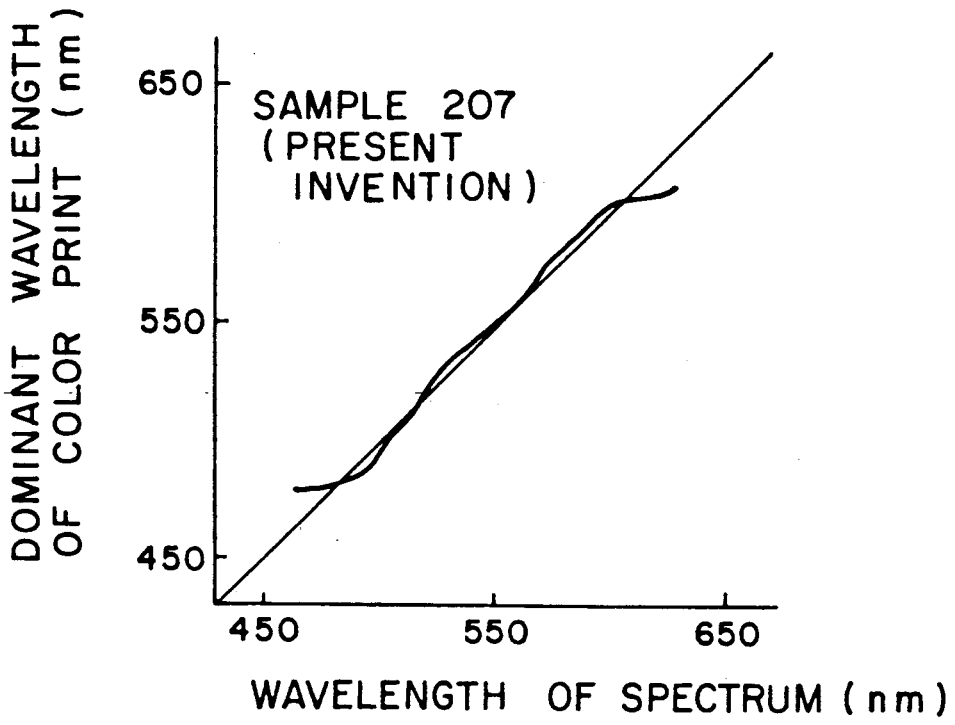

With SAMPLES 101 and 102, photographs of eleven colors selected from the Munsell color chip (color circle of Value 6, Chroma 8) were taken and printed on a color paper (Fuji Color Paper AGL #653-258) so that the gray color having the optical density of 0.7 taken at the same time becomes the same density. The results on these colors (eleven colors) except for gray were plotted according to L*a*b* color system as shown in FIG. 5. As seen from FIG. 5, the hue of SAMPLE 101 is faithful, while the saturation thereof is low and on the contrary, SAMPLE 102 has a high saturation but does not have faithful hue.

As seen from the above results, it is quite effective or important to examine the reproduced dominant wavelength of the spectral light having a low excitation purity when measuring the faithfulness of the color reproduction of a system in which the interlayer effect is observed. This fact will also be verified by referring to the results of the examples hereunder described.

We have conducted the studies on the color reproduction using the method explained above and concluded as follows. That is, if it is intended to enhance the saturation of the color light-sensitive materials while maintaining the reproduction of a spectral light, it is incomplete to simply impart the interlayer effect to any one of the light-sensitive emulsion layers of blue-, green- and red-sensitive from the other two emulsion layers and it is required to give the most preferred spectral sensitivity distribution to one of the blue-, green- and red-sensitive emulsion layers, independent of the spectral sensitivity distribution of the ohter two emulsion layers.

The spectral sensitivity distribution, $S_{-R}(\lambda)$, of the interlayer effect received by the red-sensitive layer containing a cyan dye-forming coupler should fulfill the following conditions:

a) The wavelength $\lambda_{-R}^{max}$ at which $S_{-R}(\lambda)$ is the maximum:

490 mm$\leqq\lambda_{-R}^{max}\leqq$560 mm;

b) The wavelength $\lambda_{-R}^{80}$ at which $S_{-R}(\lambda)$ is 80% of $S_{-R}(\lambda_{-R}^{max})$;

450 mm$\leqq\lambda_{-R}^{80}\leqq$534 mm, and 512 mm$\leqq\lambda_{-R}^{80}\leqq$566 mm;

c) The wavelength $\lambda_{-R}^{40}$ at which $S_{-R}(\lambda)$ is 40% of $S_{-R}(\lambda_{-R}^{max})$:

400 mm$\leqq\lambda_{-R}^{40}\leqq$512 mm, and 523 mm$\leqq\lambda_{-R}^{40}\leqq$578 mm.

Preferred ranges of $\lambda_{-R}^{max}$, $\lambda_{-R}^{80}$ and $\lambda_{-R}^{40}$ are as follows:

a) 505 mm$\leqq\lambda_{-R}^{max}\leqq$545 mm b) 492 mm$\leqq\lambda_{-R}^{80}\leqq$529 mm, and 517 mm$\leqq\lambda_{-R}^{80}\leqq$551 mm;

c) 471 mm$\leqq\lambda_{-R}^{40}\leqq$507 mm, and 528 mm$\leqq\lambda_{-R}^{40}\leqq$563 mm.

Figure 10A:
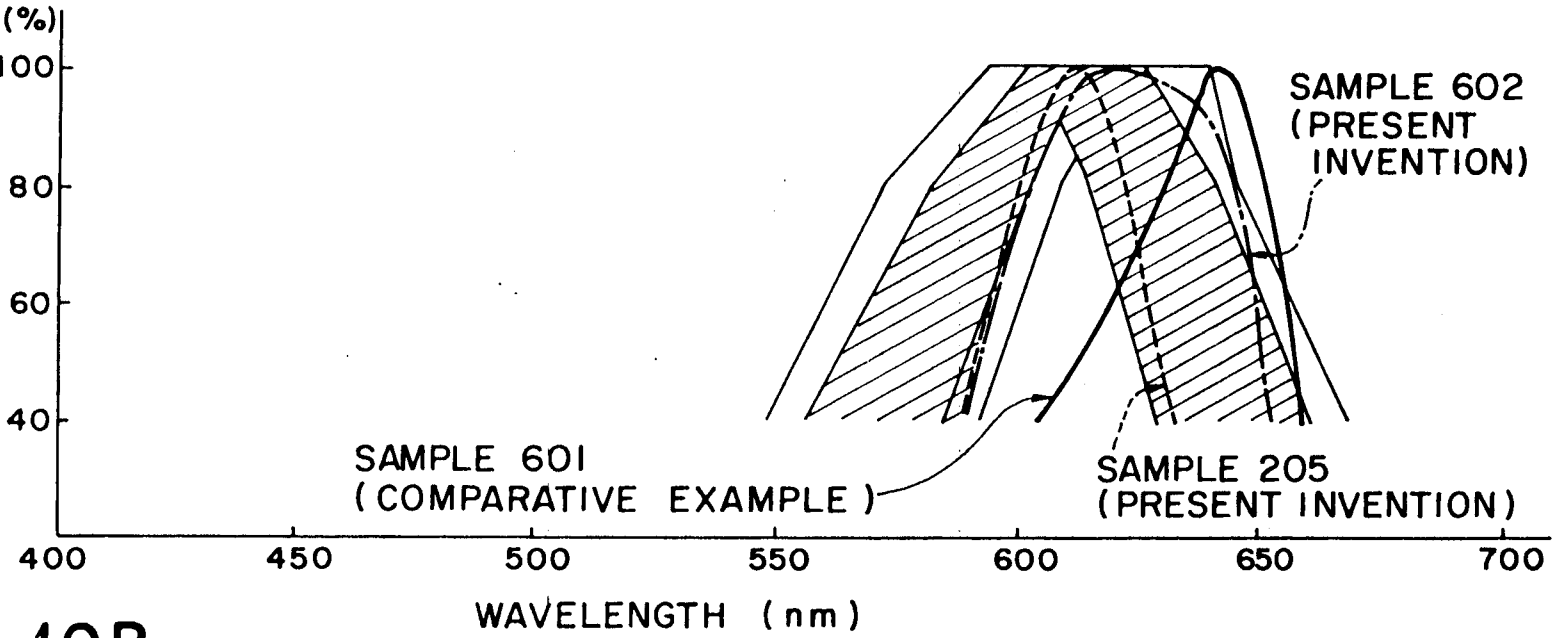
FIG. 10A shows the spectral sensitivity distribution of the red-sensitive layer in which the shaded area represents a preferred range.
Figure 10B:
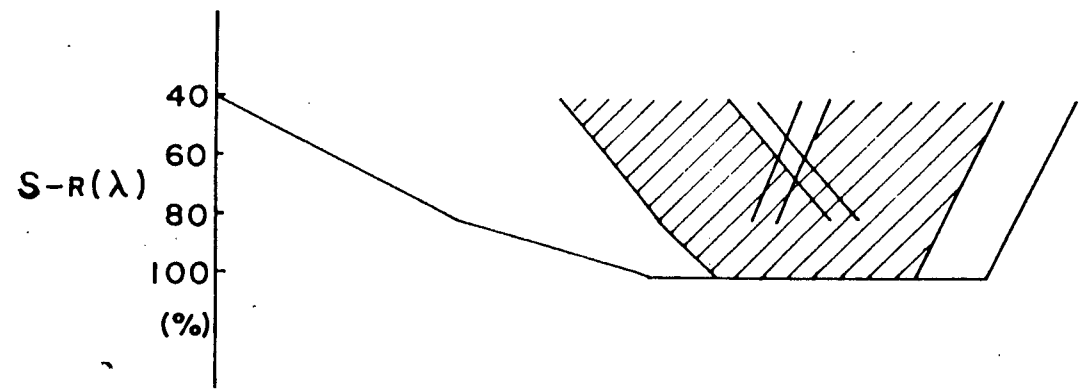
FIG. 10B shows the distribution of the interlayer effect received by the red-sensitive layer according to the present invention and the shaded part thereof is a preferred range.

These ranges are shown in FIG. 10.

This effect will hereunder be verified with reference to Example 2 described below.

EXAMPLE 2

Determination of $S_{-R}(\lambda)$

In this example, samples having a construction of layers in which only the interlayer effect received by the red-sensitive layer is changed without effecting the interlayer effect received by the blue-sensitive layer and the green-sensitive layer were prepared.

a) Preparation of SAMPLES 201 to 206

(1) A layer unit (comprising 15th and 16th layers) having the following composition was inserted between the 6th and 7th layers of SAMPLE 101:

| 15th Layer | |
|---|---|
| Silver Iodobromide Emulsion (AgI Content: 4 mole %; Average Grain Size: xμ) | 1.0 |
| Silver Iodobromide Emulsion (AgI Content: 2 mole %; Average Grain Size: yμ) | 0.3 |
| Gelatin | 1.0 |
| Sensitizing Dye An | An mole |
| Coupler C-13 | 0.2 |
| Coupler C-5 | 0.04 |
| Dispersion Oil-1 | 0.1 |
| Dispersion Oil-2 | 0.05 |

16th Layer: Identical to the 6th Layer (2) Moreover, the coated amounts of the 3rd and 4th layers were increased to 1.3 times larger than that of SAMPLE 101.

The grain sizes x, y, the kind of the sensitizing dye An and the number of moles an per mole of silver halide are listed in Table I. In this respect, the grain size of the emulsion was changed to control the sensitivity.

b) Preparation of SAMPLE 207

SAMPLE 207 was prepared according to the procedures similar to those for preparing SAMPLE 205 except that:

0.08 g/m$^2$ of nondiffusible yellow dye Y-1 was used in place of the yellow colloidal silver in the 10th layer of SAMPLE 205 and the grain sizes x and y were adjusted to control the sensitivity.

Moreover, the amounts of the sensitizing dye II used in the 7th, 8th and 9th layers were reduced to a third of those in SAMPLE 205.

These SAMPLES were subjected to the sensitometric measurement as in Example 1. As a result, the color density of the blue-sensitive layer in SAMPLE 207 was increased by 0.5, while the other SAMPLES provided curves approximately identical with each other.

Figure 7:
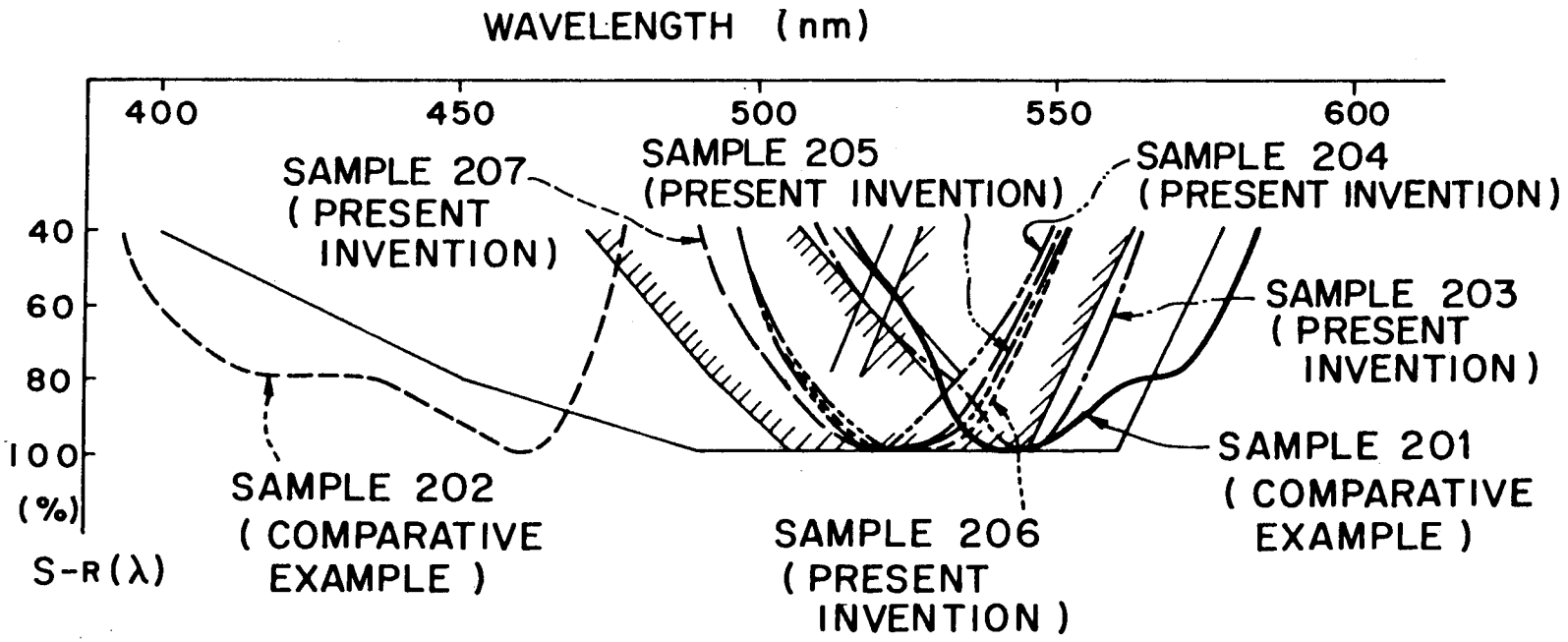
FIG. 7 shows the spectral sensitivity distribution of the interlayer effect received by the red-sensitive layer.

Then, the reproducibility of spectral light having a low excitation purity was examined. Accordingly, it was found that the spectral sensitivity distributions of the green-sensitive layer in SAMPLE 201 and the blue-sensitive layer in SAMPLE 202 were incomplete as the spectral sensitivity distribution of the interlayer effect received by the red-sensitive emulsion layer when it was intended to impart the interlayer effect to the red-sensitive layer without changing the principal wavelength of the reproduced spectrum as seen from the results shown in FIGS. 6A to 6G and that the spectral sensitivity distribution, independent of these green- and blue-sensitive layers, such as shown in FIG. 7 (SAMPLES 203 to 207) was required to give the des ed interlayer effect to the red-sensitive emulsion layer.

It is found that SAMPLES 204, 205, 206 and 207 are, in particular, excellent in the reproducibility.

With SAMPLES 201 to 207, photographs of the color rendition chart manufactured and sold by Macbeth Co. Ltd. were taken and printed on a color paper (Fuji Color Paper AGL #653-258) so that the gray having an optical density of 0.7 shows the same density on the print. The results on the reproduction of color observed with the naked eyes were as follows:

In SAMPLE 201, the purple became reddish and in SAMPLE 202, the yellow-green became yellow. While SAMPLES 203 to 207 did not present such disadvantages and in particular, SAMPLE 207 faithfully reproduced all the color chart.

The same as SAMPLE 205 except that two thirds molar amount of sensitizing dye I was substituted for the sensitizing dye II of SAMPLE 205.

Figure 8A:
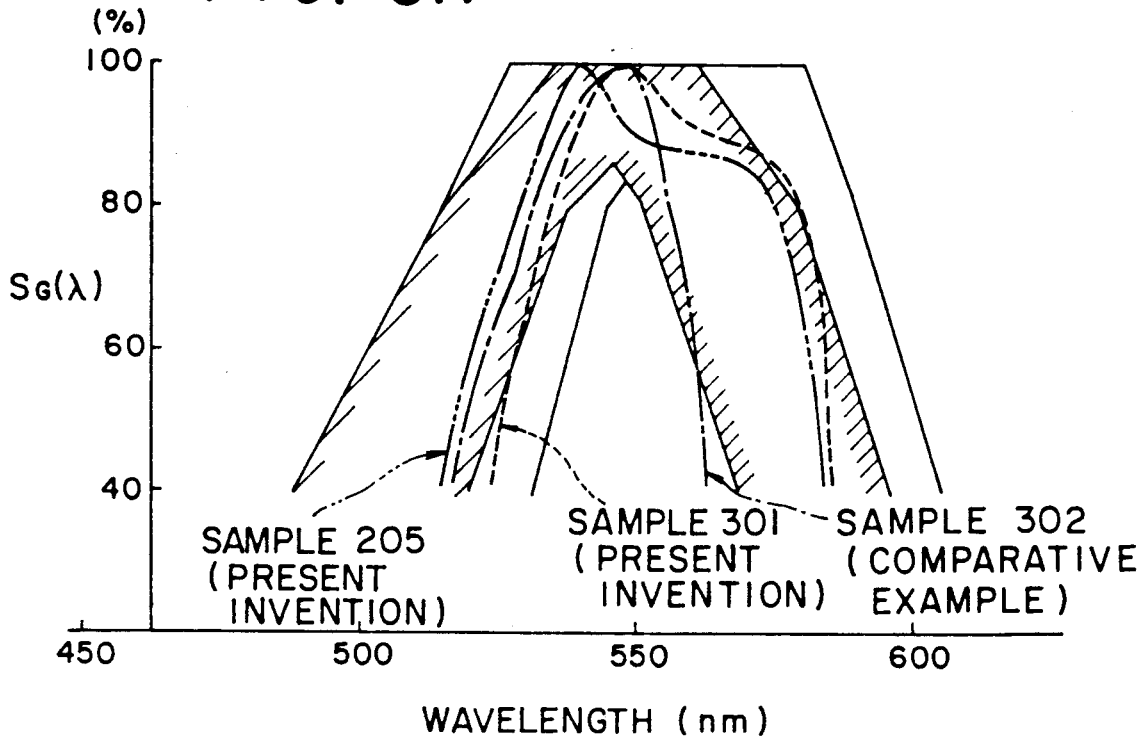
FIG. 8A and 8B show the spectral sensitivity distribution of the green-sensitive layer.
Figure 8B:
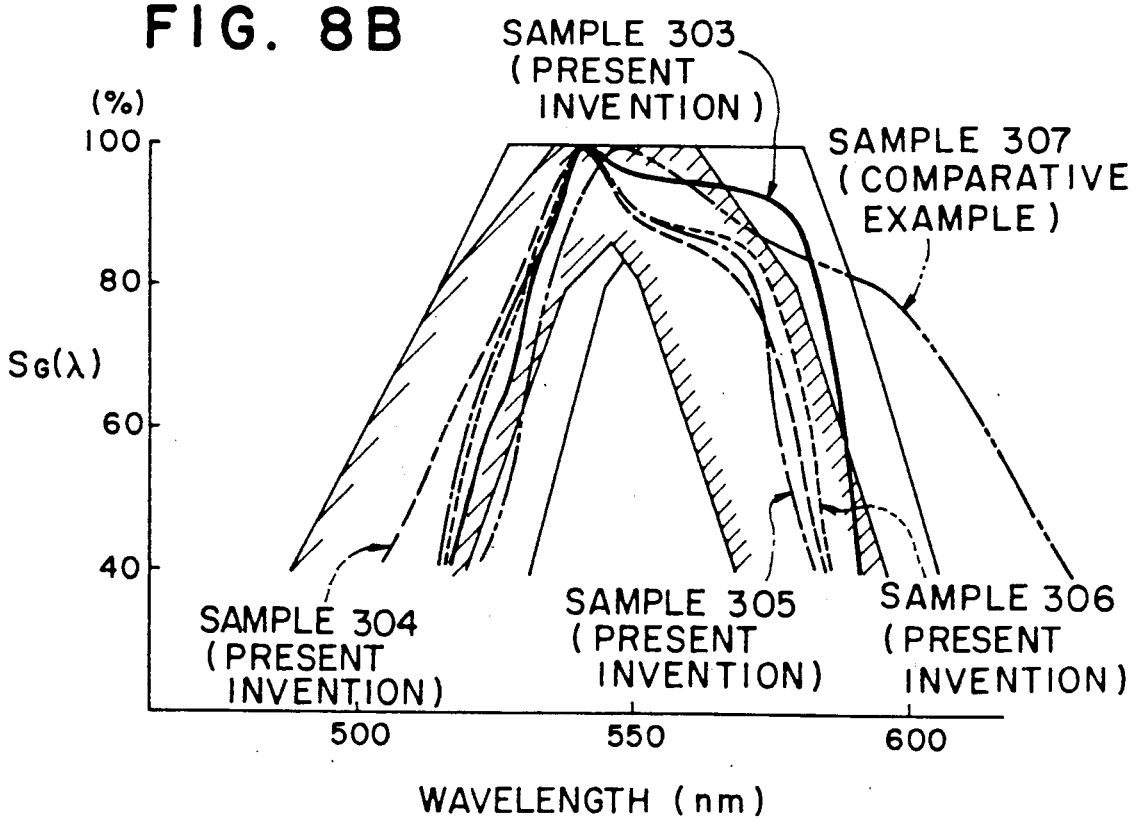
Figure 9A:
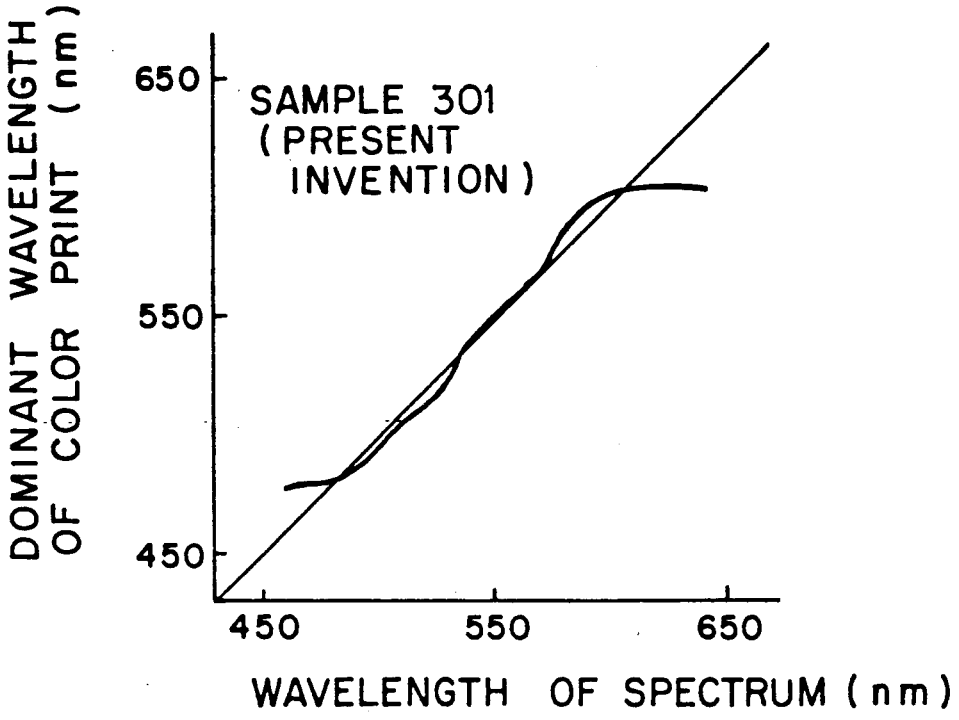
Figure 9B:
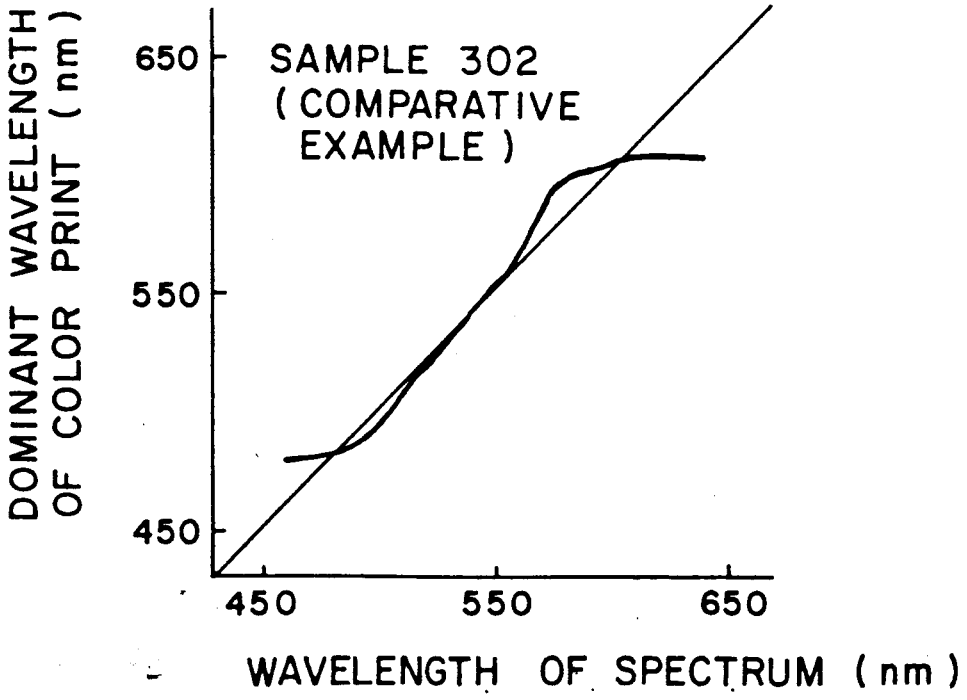
Figure 9C:
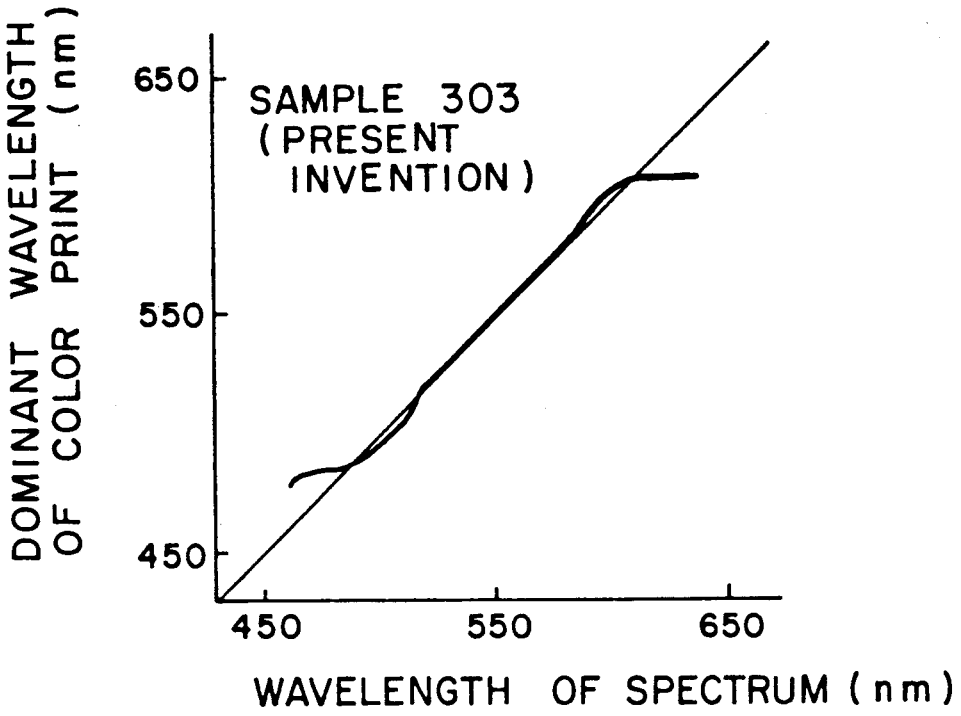
Figure 9D:
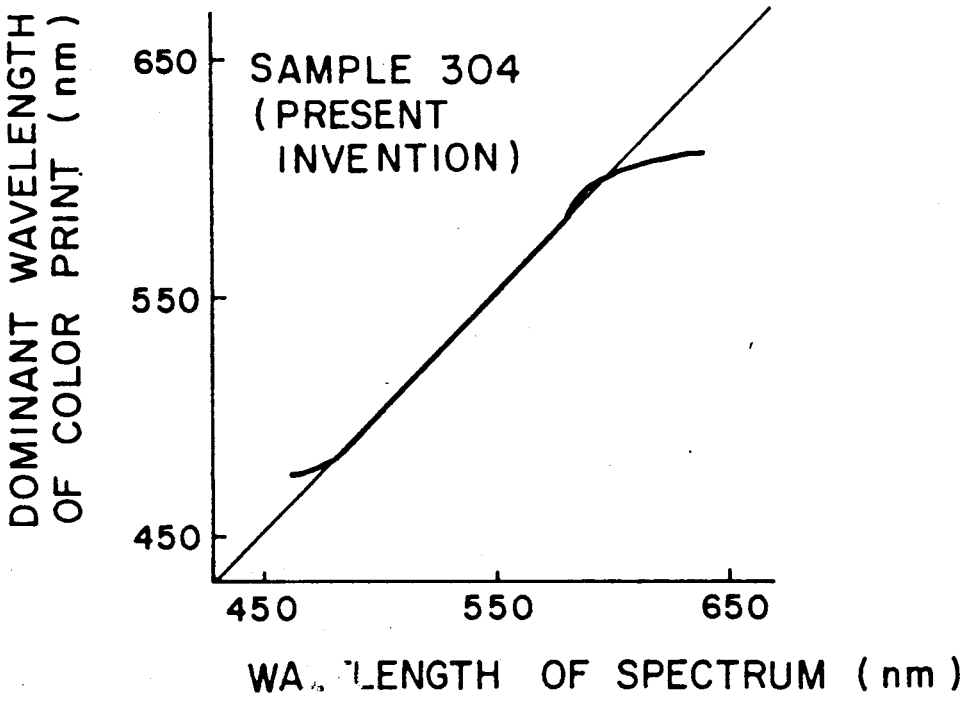
Figure 9E:
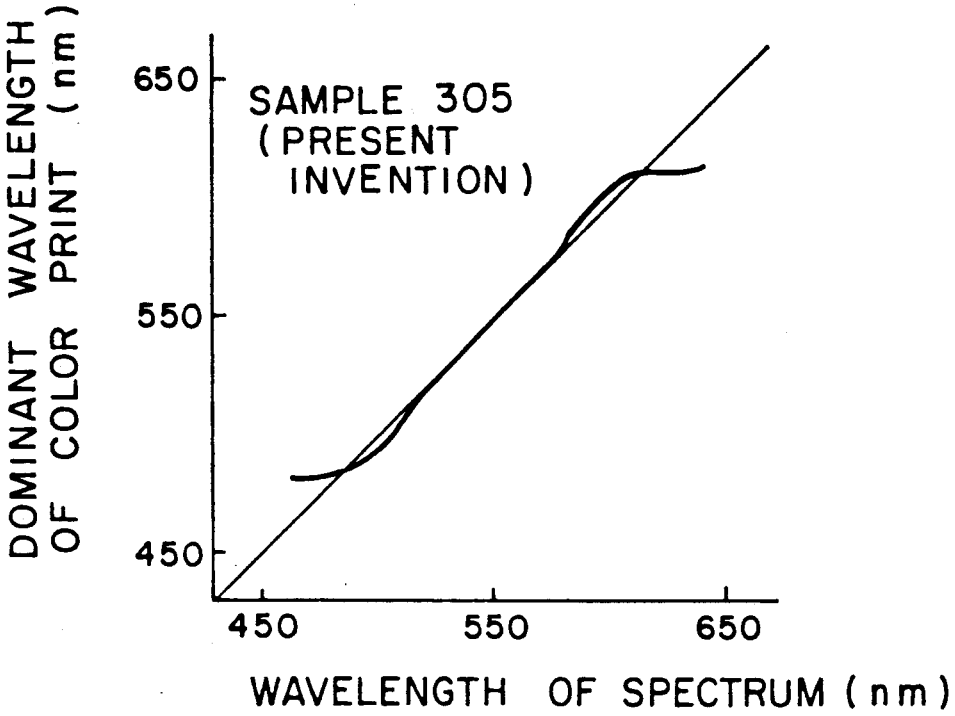
Figure 9F:
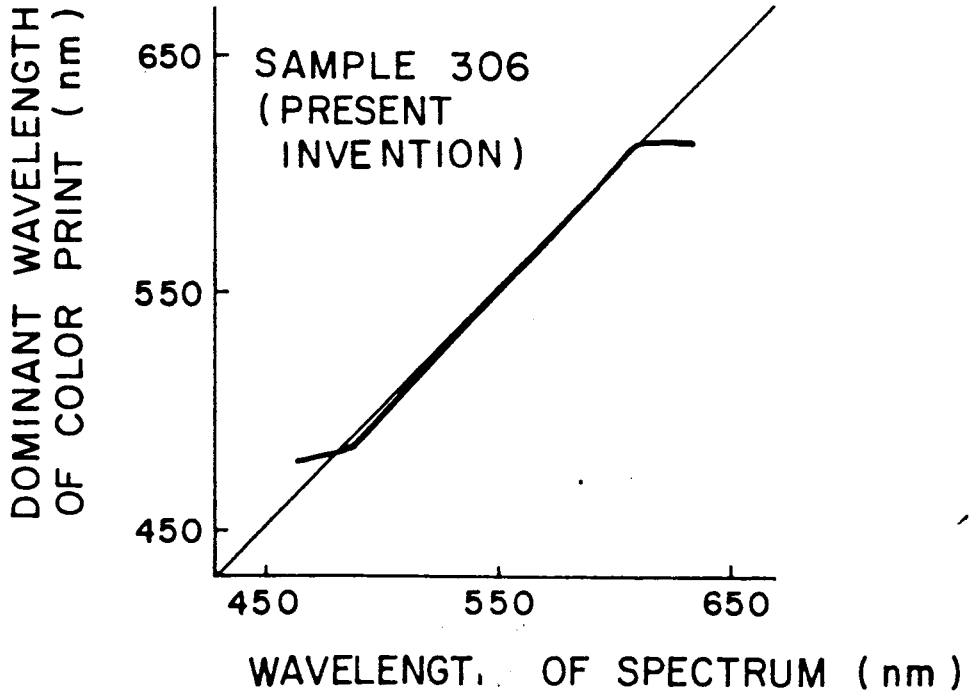
Figure 9G:
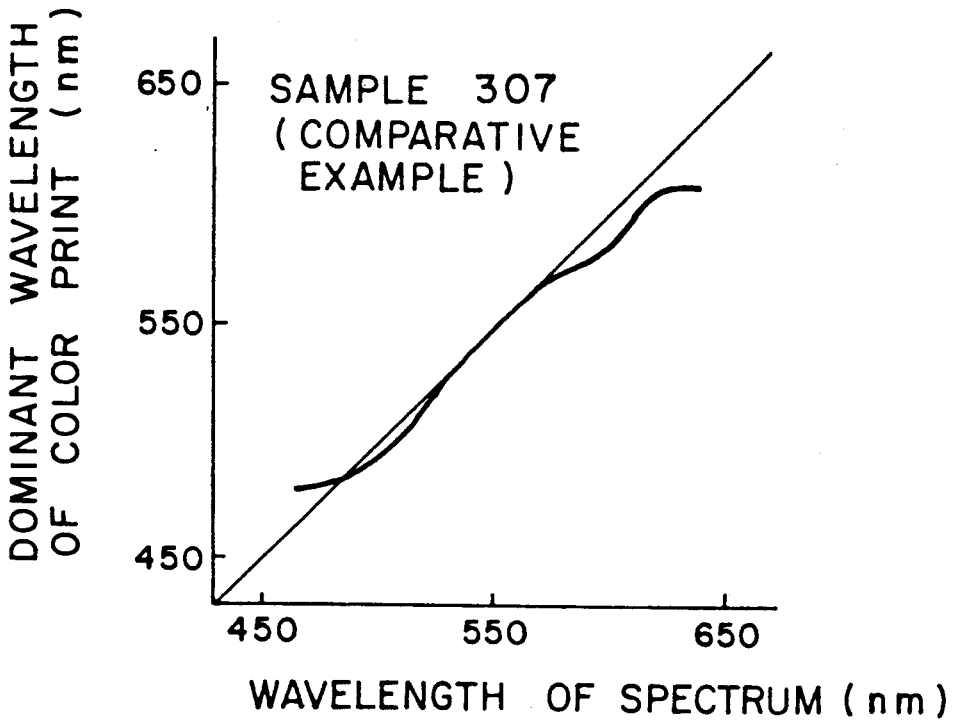

On SAMPLES 205 and 301 to 307, the sensitometric measurement was carried out as explained above and found that the same sensitivity and gradation were obtained except that the sensitivity of the green-sensitive layer of SAMPLE 304 showed an increase of 15%. The spectral sensitivity distributions of the green-sensitive layer observed on these SAMPLES are shown in FIGS. 8A and 8B and the reproduction of the spectral color observed on these SAMPLES are shown in FIGS. 9A to 9G.

These results clearly show that SAMPLES 301, 303, 304, 305 and 306 are excellent in the reproduction of spectra and in particular, SAMPLES 304, 305 and 306 are extremely excellent in this property.

TABLE I

| | Caption | | | | | | | | |
|---|---|---|---|---|---|---|---|---|---|
| | Grain Size of the Emulsion | | Amount and Kind of Dye Used in 15th Layer | | | | | | Reproduction |
| Samples | x | y | A1 | a1 | A2 | a2 | A3 | a3 | of Spectrum |
| 201 (Comparative Example) | 1.2 | 0.7 | II | $1.2 \times 10^{-4}$ | III | $1.2 \times 10^{-4}$ | IV | $0.4 \times 10^{-4}$ | not good |
| 202 (Comparative Example) | 2.0 | 1.5 | V | $0.5 \times 10^{-4}$ | — | — | — | — | not good |
| 203 (The Present Invention) | 1.5 | 1.0 | — | — | III | $2.0 \times 10^{-4}$ | — | — | good |
| 204 (The Present Invention) | 1.5 | 1.0 | II | $2 \times 10^{-4}$ | — | — | — | — | excellent |
| 205 (The Present Invention) | 1.5 | 1.0 | II | $1.6 \times 10^{-4}$ | III | $0.4 \times 10^{-4}$ | — | — | excellent |
| 206 (The Present Invention) | 1.5 | 1.0 | S-6 | $2 \times 10^{-4}$ | — | — | — | — | excellent |
| 207 (The Present Invention) | 1.2 | 0.7 | II | $1.6 \times 10^{-4}$ | III | $0.4 \times 10^{-4}$ | — | — | extremely excellent |

EXAMPLE 3

Determination of $S_G(\lambda)$

The following modifications were made on SAMPLE 205 to form SAMPLES 301 to 309.

SAMPLE 301

The sensitizing dye II of SAMPLE 205 was replaced by the equivalent moles of sensitizing dye III.

SAMPLE 302

The same as SAMPLE 205 except that equivalent moles of sensitizing dye III was used instead of the sensitizing dye IV.

SAMPLE 303

The same as SAMPLE 205 except that sensitizing dye IV was used instead of sensitizing dye III in an amount of $\frac{2}{3}$ times of the latter.

SAMPLE 304

The same as SAMPLE 205 except that the 10th layer comprises 0.08 g/m$^2$ of nondiffusible yellow dye Y-1 instead of the yellow colloidal silver used in SAMPLE 205 and the amount of the sensitizing dye II in the 15th layer was reduced to a third of that in SAMPLE 205.

SAMPLE 305

The same as SAMPLE 205 except that the amount of C-2 was increased to 1.5 times of SAMPLE 205, the coated amount of the 3rd layer was 0.85 times of SAMPLE 205 and that of the 8th layer was, on the contrary, 1.2 times thereof. This means that the masking from the red-sensitive layer to the green-sensitive layer is enhanced.

SAMPLE 306

The same as SAMPLE 305 except that a third of the sensitizing dye III was replaced by the sensitizing dye IV.

SAMPLE 307

SAMPLES 301 to 309 were used to take photographs of the color rendition chart manufactured and sold by Macbeth Co. Ltd. and they were printed on color paper (Fuji Color Paper AGL #653-258) so that the gray having an optical density of 0.7 shows the same density on the print. The results of the color reproduction observed with the naked eyes were as follows:

It was difficult to differenciate blue from cyan color in SAMPLE 307 and red from orange in SAMPLE 302. While SAMPLES 301 and 303 to 306 according to the present invention were found to faithfully reproduce colors. Among ohters, SAMPLES 305 and 306 showed a high degree of saturation of red, in particular SAMPLE 306 made it possible to substantially discriminate red from orange. Moreover, SAMPLE 304 had a high sensitivity and faithfully reproduced all the colors.

As seen from the results described above, it is verified that SAMPLES excellent in the reproduction of spectra are also excellent in reproducing colors of practical reflective materials.

EXAMPLE 4

Determination of $S_{-G}(\lambda)$ in Red-Sensitive Region

The following modifications were made on SAMPLE 205 to obtain SAMPLES 401 to 404.

(1) A layer unit (comprising 17th and 18th layers each composition of which will be described below) was inserted between the 16th and 7th layers of SAMPLE 205.

| 17th Layer | |
|---|---|
| Silver Iodobromide Emulsion (AgI Content: 6 mole %; Average | 1.0 |

-continued

| | |
|---|---|
| Grain Size: $\alpha\mu$) | |
| Silver Iodobromide Emulsion (AgI Content: 4 mole %; Average Grain Size: $\beta\mu$) | 0.3 |
| Gelatin | 1.0 |
| Sensitizing Dye Bn | bn |
| Coupler C-6 | 0.3 |
| Coupler C-5 | 0.04 |
| Dispersion Oil-1 | 0.3 |
| Dispersion Oil-2 | 0.1 |

18th Layer: The same as the 6th Layer (2) Moreover, the coated amounts of the 7th and 8th layers were increased by 20% compared with SAMPLE 205.

The grain sizes $\alpha$, $\beta$, the kind of the sensitizing dye B, and the amount thereof b used in SAMPLES 401 to 404 are listed in Table II. In a similar manner, sensitometry was conducted.

The results thereof are also shown in Table II.

Figure 11A:
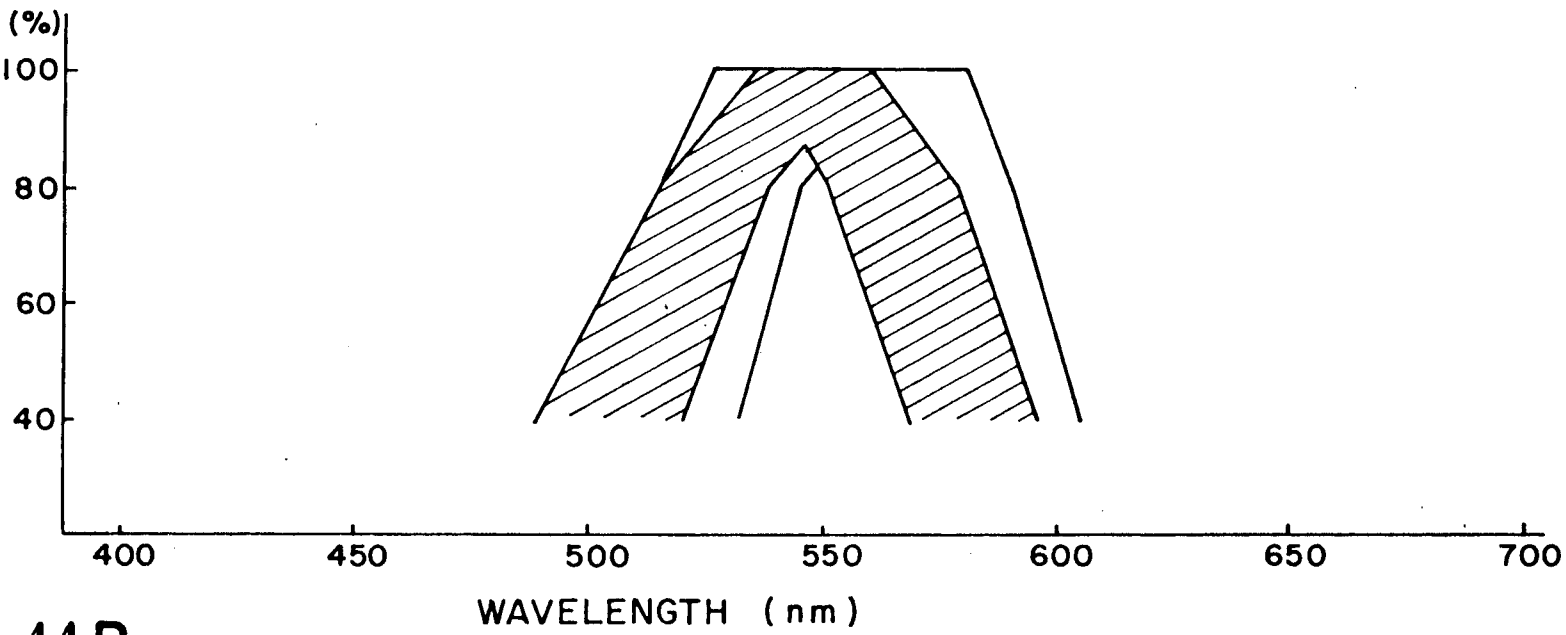
FIG. 11A shows the spectral sensitivity distribution of the green-sensitive layer of the present invention, in which the shaded area corresponds to a preferred range.

According to these results obtained, it was found that $S_{-G}(\lambda)$ as shown in FIG. 11 was preferred.

TABLE II

| | Caption | | | | | | |
|---|---|---|---|---|---|---|---|
| | Grain Size of Emulsion | | Kind and Amount of Sensitizing Dye Used in the 17th Layer | | | | Reproduction of |
| Samples | $\alpha$ | $\beta$ | B1 | b1 | B2 | b2 | Spectrum |
| 401 | 0.7 | 0.4 | I | $4 \times 10^{-4}$ | — | — | good |
| 402 | 0.7 | 0.4 | I | $2 \times 10^{-4}$ | S-7 | $2 \times 10^{-4}$ | excellent |
| 403 | 0.7 | 0.4 | — | — | S-7 | $4 \times 10^{-4}$ | extremely excellent |
| 404 | 1.0 | 0.6 | IV | $4 \times 10^{-4}$ | — | — | not good |

With SAMPLES 401 to 404, photographs of the color rendition chart manufactured and sold by Macbeth Co. Ltd. were taken and they were printed on a color paper (Fuji Color Paper AGL #653-258) so that the gray having an optical density of 0.7 shows the same density on the print. The results of the color reproduction observed with the naked eyes were as follows:

It was difficult to differentiate orange from red in SAMPLE 404, on the contrary, SAMPLES 401 to 403 showed the faithful color reproduction. Moreover, SAMPLE 403 had an excellent color reproduction such that the cardinal red of natural rose flowers can be discriminated from the vermilion one when it was used to take a photo of the rose flowers.

EXAMPLE 5

Determination of $S_B(\lambda)$

The following modifications were made on SAMPLE 205 to prepare SAMPLES 501 to 503.

SAMPLE 501

The amount of the sensitizing dye V was increased to 1.5 times compared with SAMPLE 205.

SAMPLE 502

The same as SAMPLE 205 except that the sensitizing dye V was not used.

SAMPLE 503

The same as SAMPLE 205 except that 0.2 g/m$^2$ of UV-3 was added to the 13th layer of SAMPLE 205 and the grain sizes of silver halide in the 11th and 12th layers were increased by about 10%.

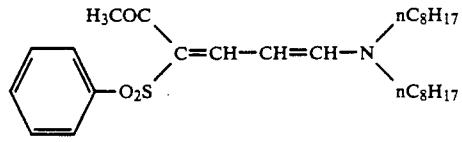

UV-3

Figures 12A, 12B:
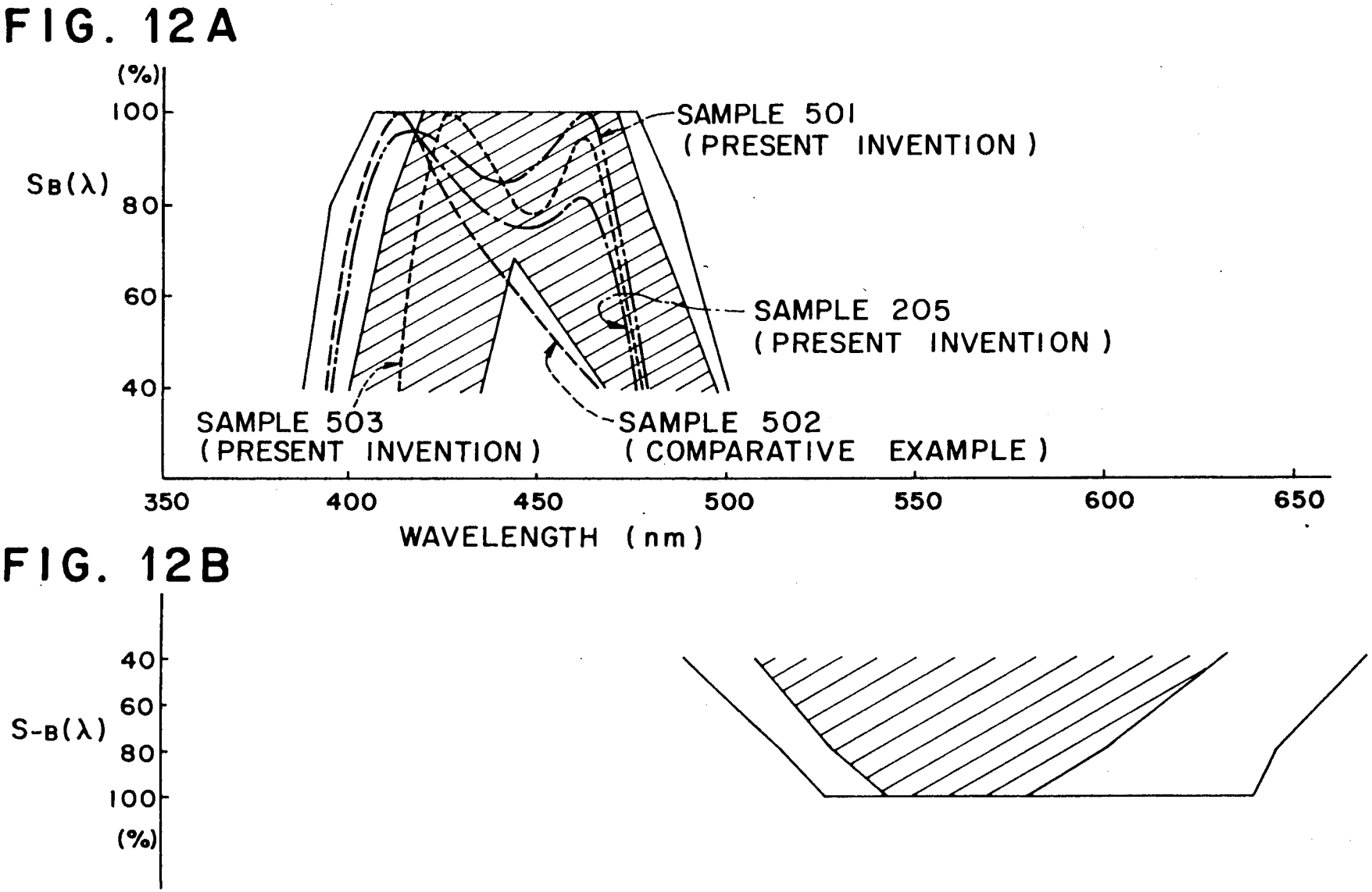
FIG. 12A shows the preferred spectral sensitivity distribution of the blue-sensitive layer and the shaded area thereof represents the more preferred one.
FIG. 12B shows the preferred distribution of the interlayer effect received by the blue-sensitive layer and the shaded area represents a preferred one.

The resulting spectral sensitivity distribution is shown in FIG. 12A.

With these SAMPLES 501 to 503, photographs of the color rendition chart manufactured and sold by Macbeth Co. Ltd. were taken under the irradiation of fluorescent light, solar light or tungsten light and they were printed on a color paper (Fuji Color Paper AGL #653-258) so that the gray having an optical density of 0.7 shows the same density on the print. According to the observation with the naked eyes, SAMPLES 205, 501, 503 did not show variation in the color reproduction irrespective of the kind of light sources and among others, SAMPLE 503 showed the smallest change in the color reproduction and was the most excellent one.

EXAMPLE 6

Determination of $S_R(\lambda)$

The following modifications were made on SAMPLE 205 to prepare SAMPLES 601 and 602.

SAMPLE 601

The same as SAMPLE 205 except that the equivalent moles of sensitizing dye S-7 was used in place of the sensitizing dye I in SAMPLE 205.

SAMPLE 602

The same as SAMPLE 205 except that two thirds of the sensitizing dye I used in SAMPLE 205 was replaced by the equivalent moles of sensitizing dye S-7.

Sensitizing Dye S-7

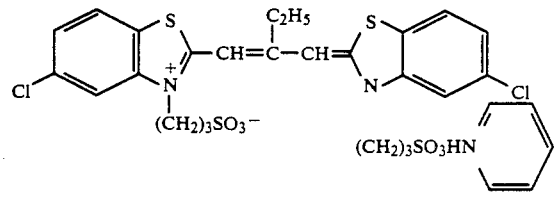

The resulting spectral sensitivity distribution is shown in FIG. 10A.

Photographs of the color rendition chart manufactured and sold by Macbeth Co. Ltd. were taken using these SAMPLES 205, 601 and 602 and printed on a color paper (Fuji Color Paper AGL #653-258) so that the gray which had an optical density of 0.7 show the same density on the print. The results on the color reproduction observed with the naked eyes were as follows:

SAMPLE 601 was not good since the colors of purple and blue flowers were tinged with red. While SAMPLES 205 and 602 according to the invention were excellent in the reproduction of such colors and particularly SAMPLE 205 faithfully reproduced the colors.

Figure 11B:
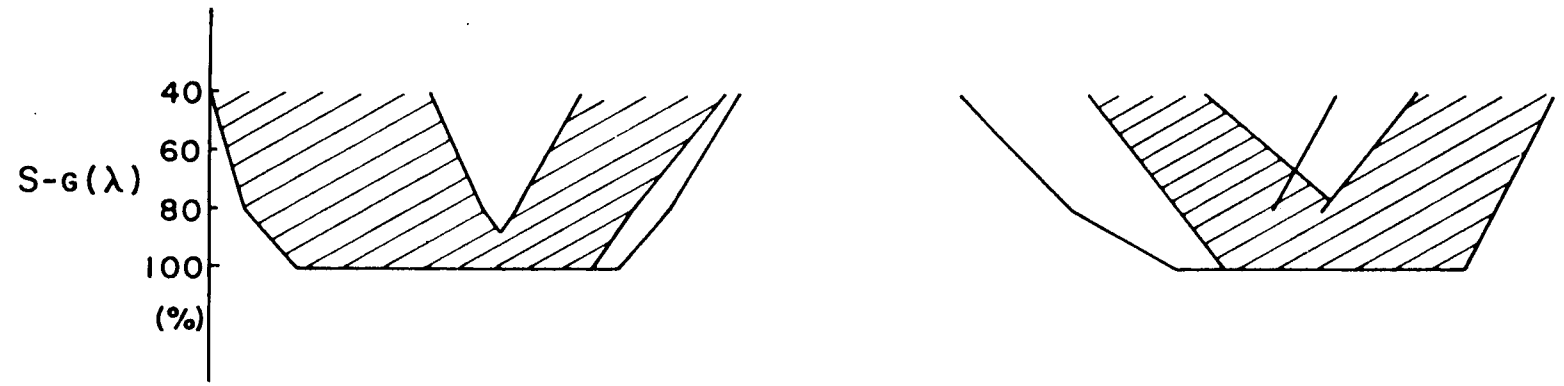
FIG. 11B shows the preferred distribution of the interlayer effect received by the green-sensitive layer and the shaded area thereof represents a preferred one.

According to the similar procedures as in Examples 1 to 4 described above, the preferred ranges in the blue-sensitive region [$S_{-G}(\lambda)$] and the green- to red-sensitive regions [$S_{-B}(\lambda)$] were determined. The results obtained are shown in FIGS. 11B and 12B.

Moreover, in order to ascertain the generality of the present invention, the same test was conducted utilizing a color paper in which pyrazoloazole coupler disclosed in U.S. Pat. Nos. 3,725,067 and 4,500,630 and European Patent No. 119,860A is used as the magenta coupler. As a result, it was found that the saturation of red, magenta, purple, blue or the like is substantially improved without changing the faithfulness of the color reproduction which is one of the advantages of the present invention and thus, a quite excellent color reproduction is achieved according to the present invention.

EXAMPLE 7

(A) On a cellulose triacetate film support having an undercoating, there was formed a multilayer color light-sensitive material (SAMPLE 701) consisting of the layers having the following compositions respectively.

The amounts of silver halide and colloidal silver coated are expressed in grams of silver per square meter, those of the couplers, additives and gelatin are expressed in grams thereof per square meter and those of the sensitizing dyes are expressed in moles thereof per mole of silver halide included in the same layer.

With SAMPLE 701, in the same manner as in Examples 1 to 6, photographs of the color rendition chart manufactured and sold by Macbeth Co., Ltd. were taken and printed on a color paper in which 5-pyrazolone magenta coupler is used, so that the gray having an optical density of 0.7 shows the same density on the print. The results on the reproduction of color observed with the naked eyes were excellent as follows:

(i) It was high in saturation and faithfully reproduced purple, yellow-green, light flesh, dark flesh and blue-flower colors.

(ii) It was excellent in discrimination between blue and cyan, and red and orange.

The same experiment was carried out using the color paper used in Example 1 in which pyrazoloazole magenta coupler is used. The results showed that saturation of magenta, blue and red colors was further enhanced.

(B) The same procedures as described in the item (A) above were repeated except that a stabilization process was carried out according to the multi-stage counter-current process as described in Japanese Patent Appln. (OPI) 57-8543. The same results were obtained.

Further, the same procedures as described in the item (A) above were repeated except that the bleaching—water washing—fixing steps were replaced by the bleaching—bleachfixing steps in which the bleachfixing was carried out immediately after the bleaching step, i.e., without the water washing step. Sufficient desilvering was effected so that color reproduction was excellent.

The same excellent results were obtained when the photographic material was processed by a development process wherein the amount of a development replenisher was greatly reduced.

| | |
|---|---|
| 1st Layer (Anti-halation Layer) | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| 2nd Layer (Intermediate Layer) | |
| Solv-1 | 0.1 |
| ExF-1 | 0.004 |
| Solv-2 | 0.1 |
| Gelatin | 1.0 |
| UV-1 | 0.3 |
| ExC-4 | 0.02 |
| 3rd Layer (Low Speed Red-sensitive Emulsion Layer) | |
| Silver Iodobromide Emulsion (AgI 4 mole %, AgI uniformly contained, Corresponding spherical diameter (diameter of a sphere having the same volume as that of the grains): 0.5μ Deviation coefficient of corresponding spherical diameter (hereinafter referred to as "Deviation coefficient") 20%, Tabular grains, Diameter/thickness ratio 3.0) | 1.2 |
| Silver Iodobromide Emulsion (AgI 3 mole %, AgI uniformly contained, Corresponding spherical diameter 0.3μ, Deviation coefficient 15%, spherical grains, Diameter/thickness ratio 1.0) | 0.6 |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| 4th Layer (High-speed Red-sensitive Emulsion Layer) | |
| Silver Iodobromide Emulsion (AgI 6 mole %, High AgI content in internal layer, Corresponding spherical diameter 0.7μ, Deivation coefficient 15%, Tabular grains, Diameter/thickness ratio 5.0) | 0.7 |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| 5th Layer (Intermediate Layer) | |
| Gelatin | 0.5 |
| Cpd-1 | 0.1 |
| Solv-1 | 0.05 |
| 6th Layer (Low-speed Green-Sensitive Emulsion Layer) | |
| Silver Iodobromide Emulsion (AgI 4 mole %, High AgI content in surface layer, Corresponding spherical diameter 0.5μ, Deviation coefficient 15%, Tabular grains, Diameter/thickness ratio 4.0) | 0.35 |
| Silver Iodobromide Emulsion (AgI 3 mole %, AgI uniformly contained, Corresponding spherical diameter 0.3μ, Deviation coefficient 25%, Spherical grains, Diameter/thickness ratio 1.0) | 0.20 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.03 |
| ExY-11 | 0.03 |

-continued

| | |
|---|---|
| Solv-1 | 0.3 |
| Solv-4 | 0.05 |
| 7th Layer (High-speed Green-sensitive Emulsion Layer) | |
| Silver Iodobromide Emulsion (AgI 4 mole %, High AgI content in internal layer, Corresponding spherical diameter 0.7μ, Deviation coefficient 20%, Tabular grains, Diameter/thickness ratio 5.0) | 0.8 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| 8th Layer (Intermediate Layer) | |
| Gelatin | 0.5 |
| Cpd-1 | 0.05 |
| Solv-1 | 0.02 |
| 9th Layer (Donor Layer of Interlayer Effect) | |
| Silver Iodobromide Emulsion (AgI 2 mole %, High AgI content in internal layer, Corresponding spherical diameter 1.0μ, Deviation coefficient 15%, Tabular grains, Diameter/thickness ratio 6.0) | 0.35 |
| Silver Iodobromide Emulsion (AgI 2 mole %, High AgI content in internal layer, Corresponding spherical diameter 0.4μ, Deviation coefficient 20%, Tabular grains, Diameter/thickness ratio 6.0) | 0.20 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| 10th Layer (Yellow-filter Layer) | |
| Yellow colloidal silver | 0.05 |
| Gelatin | 0.5 |
| Cpd-2 | 0.13 |
| Cpd-1 | 0.10 |
| 11th Layer (Low-speed Blue-sensitive Emulsion Layer) | |
| Silver Iodobromide Emulsion (AgI 4.5 mole %, AgI uniformly contained, Corresponding spherical diameter 0.7μ, Deviation coefficient 15%, Tabular grains, Diameter/thickness ratio 7.0) | 0.3 |
| Silver Iodobromide Emulsion (AgI 3 mole %, AgI uniformly contained, Corresponding spherical diameter 0.3μ, Deviation coefficient 25%, Tabular grains, Diameter/thickness ratio 7.0) | 0.15 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExC-17 | 1.0 |
| Solv-1 | 0.20 |
| 12th Layer (High-speed Blue-sensitive Emulsion Layer) | |
| Silver Iodobromide Emulsion (AgI 10 mole %, High AgI content in internal layer, Corresponding spherical diameter 1.0μ, Deviation coefficient 25%, Amorphous grains, Diameter/thickness ratio 2.0) | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| 13th Layer (First Protective Layer) | |
| Gelatin | 0.8 |
| UV-4 | 0.1 |
| UV-5 | 0.15 |
| Solv-1 | 0.01 |
| Solv-2 | 0.01 |
| 14th Layer (Second Protective Layer) | |
| Fine Silver Bromide Grains (2 mole, s/r = 0.2, 0.07μ) | 0.5 |
| Gelatin | 0.45 |
| Polymethylmethacrylate Particles (Diameter 1.5μ) | 0.2 |
| H-1 | 0.4 |
| Cpd-3 | 0.5 |
| Cpd-4 | 0.5 |

In addition to the above constituents, an emulsion stabilizer Cpd-3 and a surfactant Cpd-4 as a coating aid as well as Cpd-5 and Cpd-6 were added to each layer.

| | |
|---|---|
| 0.4 | H-1 |
| 0.5 | Cpd-3 |
| 0.5 | Cpd-4 |

UV-1

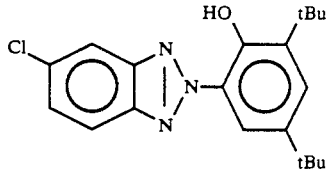

UV-2

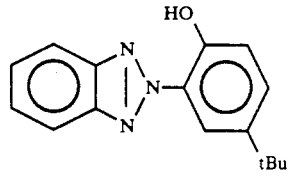

UV-3

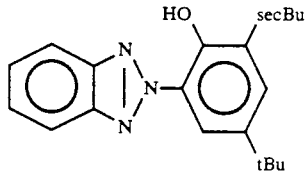

-continued
UV-4
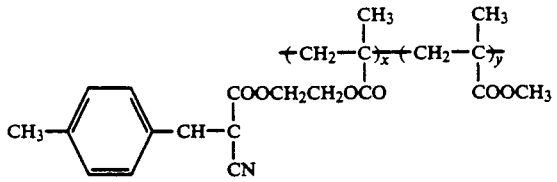
x/y = 7/3 (by weight)
UV-5
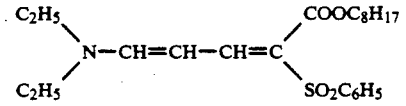
Tricresyl phosphate — Solv-1
Dibutyl phthalate — Solv-2
Solv-3
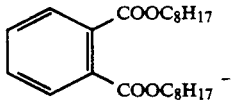
Solv-4
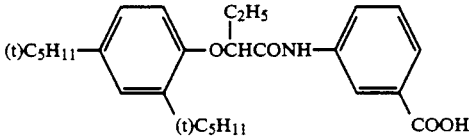
Cpd-1
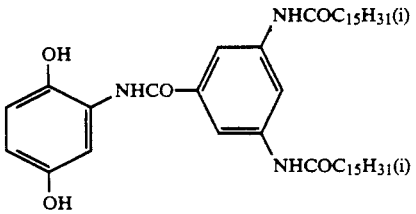
Cpd-2
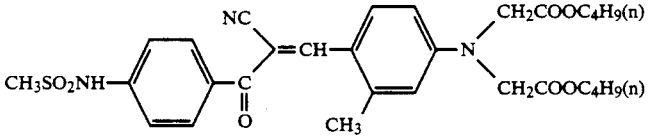
Cpd-3
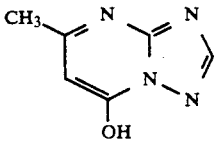
Cpd-4
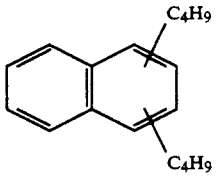
Cpd-5
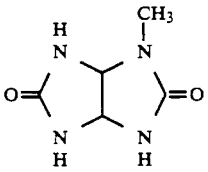

-continued
Cpd-6
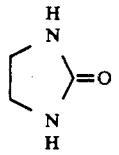
EXC-1
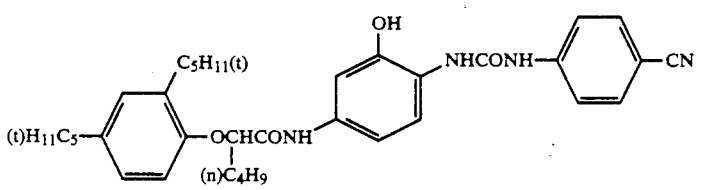
EXC-2
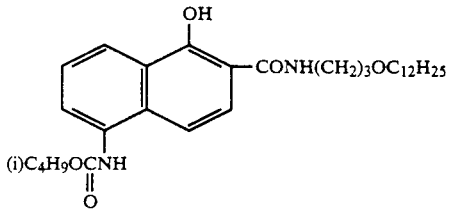
EXC-3
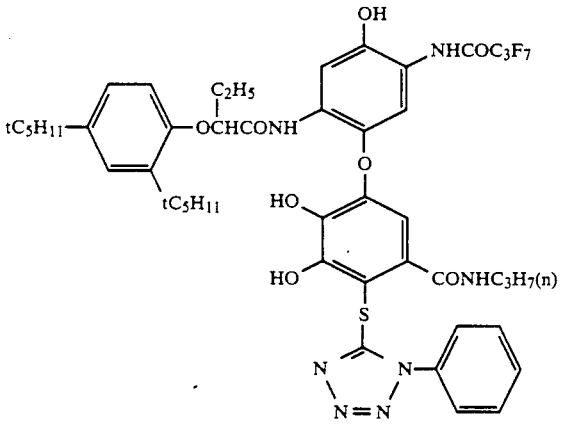
EXC-4
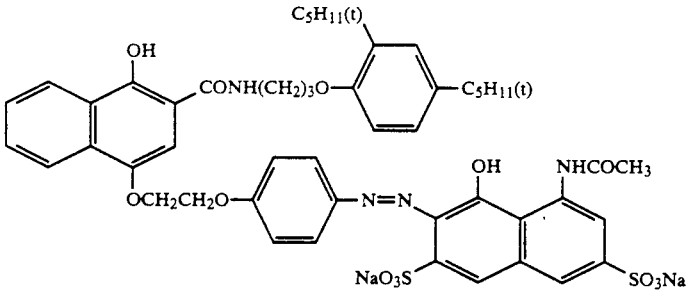
EXC-5
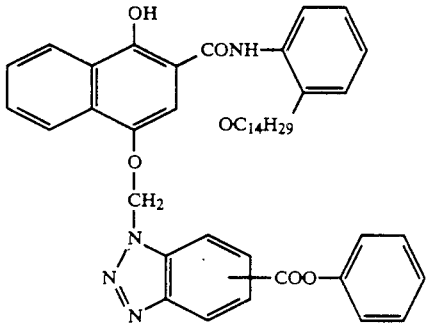

-continued
EXC-6
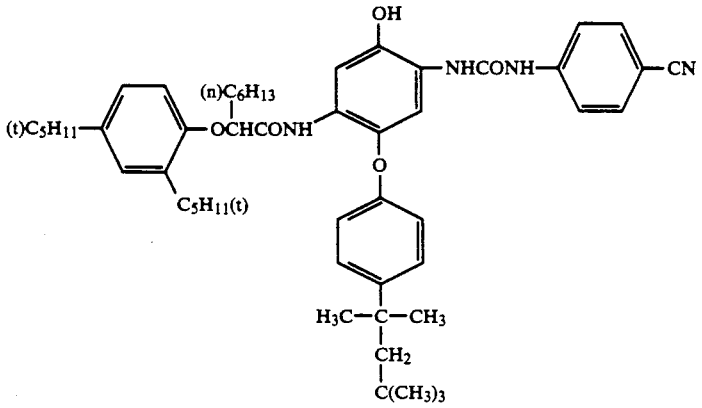
EXC-7
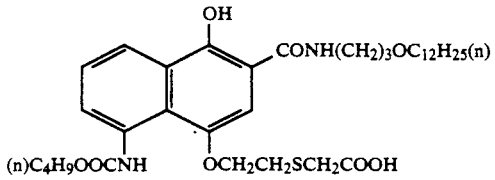
MW. 662.9
EXM-8
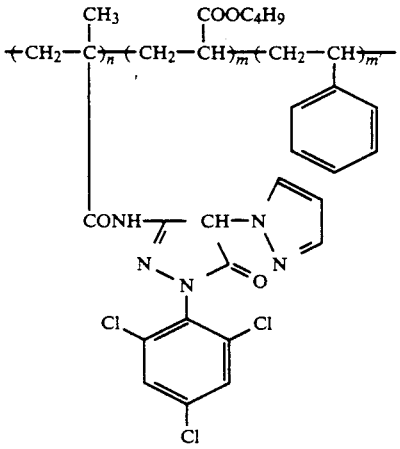
n = 50, m = 25, m' = 25
mol. wt. c.a. 20,000
EXM-9
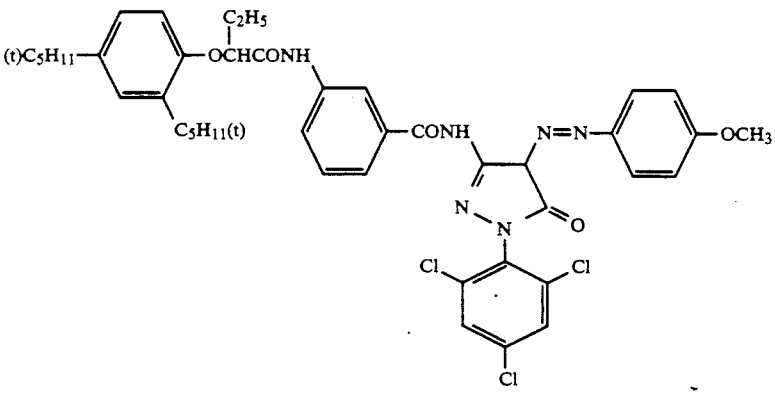

-continued
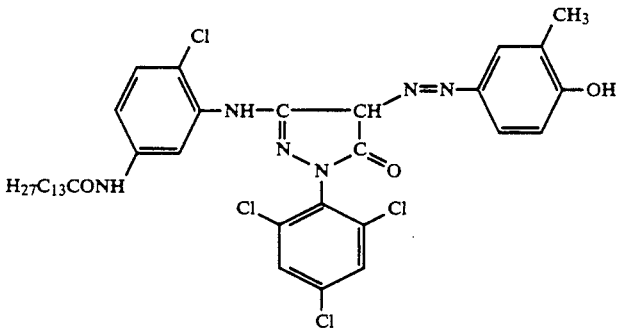
EXM-10
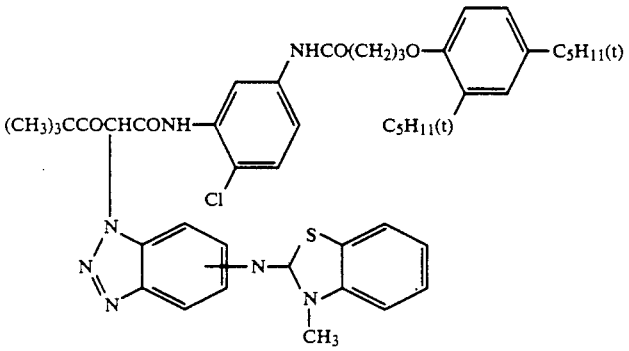
EXY-11
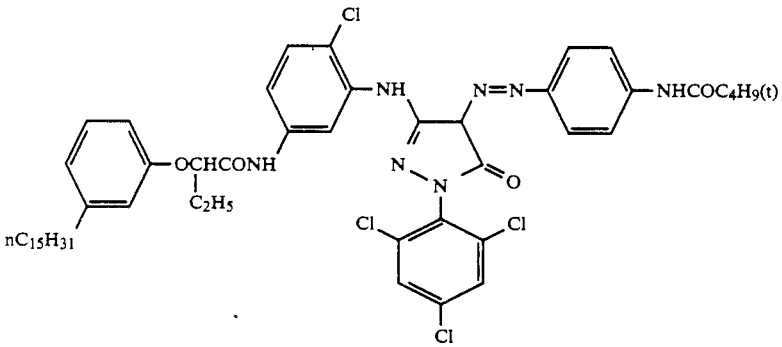
EXM-12
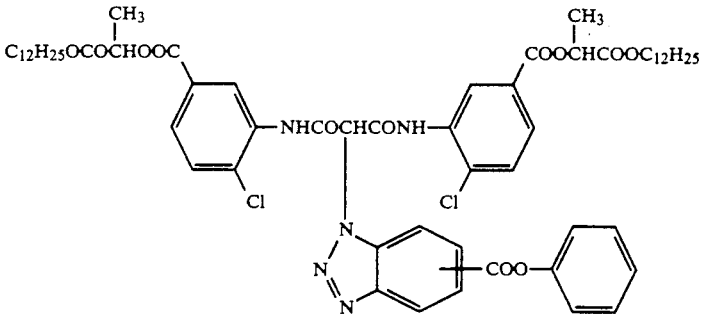
EXY-13

-continued
EXM-14
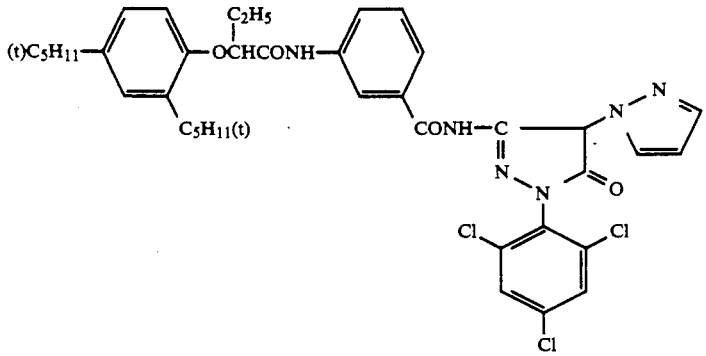
EXY-15
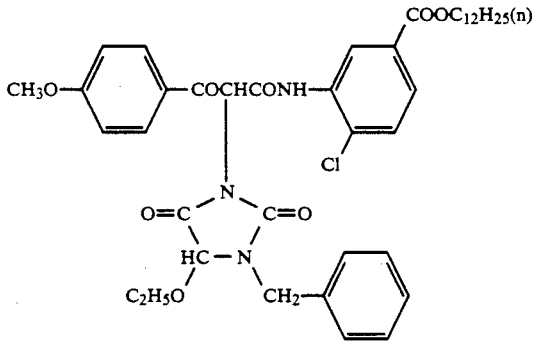
EXC-16
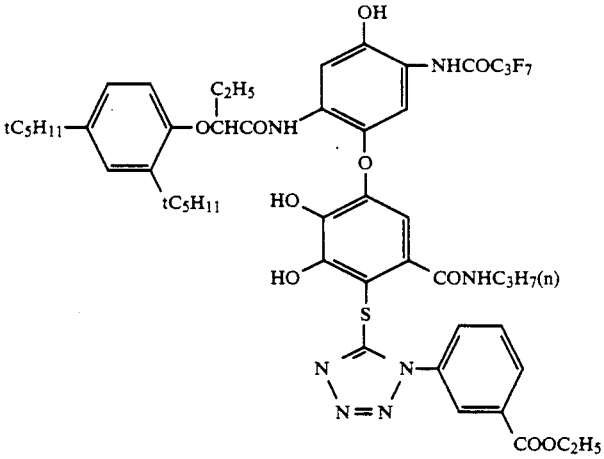
EXY-17
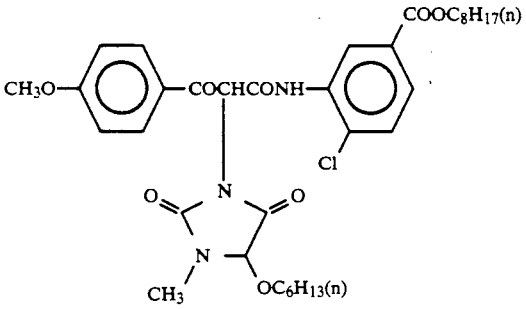
EXS-1
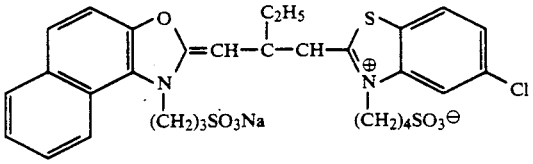

-continued

EXS-2

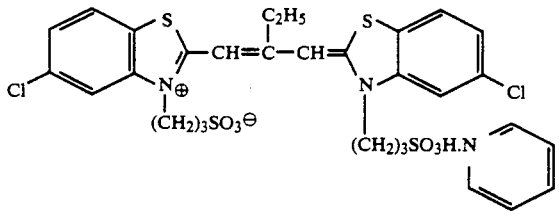

EXS-3

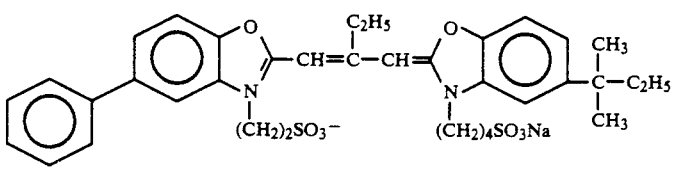

MW 717

EXS-4

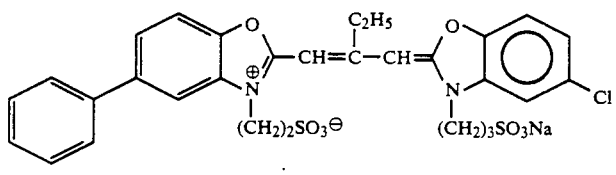

EXS-5

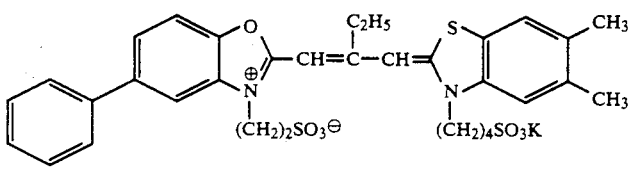

EXS-6

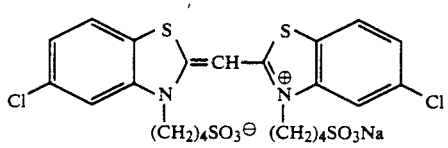

H-1

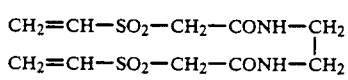

What is claimed is:

1. A silver halide color light-sensitive material comprising, on a support, at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, the weight-averaged wavelength, $\lambda_G$, of spectral sensitivity distribution of the green-sensitive silver halide emulsion layer being in the range of from 520 nm to 580 nm, the weight-averaged wavelength, $\lambda_{-R}$, of spectral sensitivity distribution of the interlayer effect received by the red-sensitive silver halide emulsion layer in the range of from 500 nm to 600 nm being in the range of from 500 nm to 560 nm and the difference between the $\lambda_G$ and $\lambda_{-R}$ ($\lambda_G-\lambda_{-R}$) being 5 nm or more, wherein the spectral sensitivity distribution $S_{-R}(\lambda)$ of the interlayer effect received by the red-sensitive emulsion layer satisfies the following conditions:

(a) the wavelength $\lambda_{-R}^{max}$ at which $S_{-R}(\lambda)$ is the maximum is in the range of from 490 nm to 560 nm;

(b) the wavelength $\lambda_{-R}^{80}$ at which $S_{-R}(\lambda)$ equals to 80% of $S_{-R}(\lambda_{-R}^{max})$ is in the range of from 450 to 534 nm and from 512 to 566 nm; and (c) the wavelength $\lambda_{-R}^{40}$ at which $S_{-R}(\lambda)$ equals to 40% of $S_{-R}(\lambda_{-R}^{max})$ is in the range of from 400 to 512 nm and from 523 to 578 nm, and wherein the light-sensitive material contains at least one member selected from the group consisting of a DIR compound and a color masking compound which provides the interlayer effect received by the red-sensitive emulsion layer.

2. The silver halide color light-sensitive material as set forth in claim 1 wherein the wavelengths $\lambda_{-R}^{max}$, $\lambda_{-R}^{80}$ and $\lambda_{-R}^{40}$ are in the following ranges respectively:

505 nm$\leqq\lambda_{-R}^{max}\leqq$545 nm;

(ii) 492 nm$\leqq\lambda_{-R}^{80}\leqq$529 nm, and 517 nm$\leqq\lambda_{-R}^{80}\leqq$551 nm; and (iii) 471 nm$\leqq\lambda_{-R}^{40}\leqq$507 nm, and 528 nm$\leqq\lambda_{-R}^{40}\leqq$563 nm.

3. The silver halide color light-sensitive material as set forth in claim 1 wherein the weight-averaged wavelength $\lambda_{-R}$ of the spectral sensitivity distribution of the interlayer effect received by the red-sensitive silver halide emulsion layer is in the range of from 500 to 530 nm.

4. The silver halide color light-sensitive material as set forth in claim [illegible] wherein the material comprises at least one member selected from the group consisting of yellow filters and ultraviolet light absorbing filters.

5. The silver halide color light-sensitive material as set forth in claim 4 wherein the yellow filter contains at least one member selected from the group consisting of colloidal silver particles, yellow colored magenta couplers and yellow nondiffusible organic dyes.

6. The silver halide color light-sensitive material as set forth in claim 1 wherein the yellow dye-forming color coupler is a hydrophobic acylacetamide coupler having ballast groups.

7. The silver halide color light-sensitive material as set forth in claim 6 wherein the yellow dye-forming color coupler is a two equivalent yellow coupler.

8. The silver halide color light-sensitive material as set forth in claim 1 wherein the magenta dye-forming color coupler is selected from 2-equivalent 5-pyrazolone type couplers.

9. The silver halide color light-sensitive material as set forth in claim 1 wherein the magenta dye-forming color coupler is selected from polymerized magenta couplers.

10. The silver halide color light-sensitive material as set forth in claim 1 wherein the cyan dye-forming color coupler is selected from 2-equivalent naphthol or phenol type couplers.

11. The silver halide color light-sensitive material as set forth in claim 1 wherein the cyan dye-forming color coupler is a member selected from the group consisting of phenol type couplers having a phenylureido group at the 2-position and an acylamino group at the 5-position and naphthol type couplers having at the 5-position a substituent such as sulfonamide or carboxylic acid amide group.

12. The silver halide color light-sensitive material as set forth in claim 1 wherein at least one of the blue-, green- and red-sensitive layers comprises a colored coupler for masking.

13. The silver halide color light-sensitive material as set forth in claim 1 wherein the yellow dye-forming color coupler is selected from hydrophobic acylacetamide couplers having ballast groups, the magenta dye-forming color coupler is selected from 5-pyrazolone type couplers and pyrazolo [5, 1-c] [1, 2, 4] triazole type couplers and the cyan dye-forming color coupler is selected from hydrophobic and nondiffusible naphthol and phenol couplers.

14. The silver halide color light-sensitive material as set forth in claim 1 wherein the yellow dye-forming color coupler is selected from hydrophobic acylacetamide couplers having ballast groups, the magenta dye-forming color coupler is selected from 5-pyrazolone type couplers and pyrazolo [5, 1-c] [1, 2, 4] triazole type couplers, the cyan dye-forming color coupler is selected from hydrophobic and nondiffusible naphthol and phenol couplers and the wavelengths $\lambda_{-R}^{max}$, $\lambda_{-R}^{80}$ and $\lambda_{-R}^{40}$ are in the following ranges respectively:

(i) 505 nm$\leqq\lambda_{-R}^{max}\leqq$545 nm (ii) 492 nm$\leqq\lambda_{-R}^{80}\leqq$529 nm, and 517 nm$\leqq\lambda_{-R}^{80}\leqq$551 nm; and (iii) 471 nm$\leqq\lambda_{-R}^{40}\leqq$507 nm, and 528 nm$\leqq\lambda_{-R}^{40}\leqq$563 nm.

15. The silver halide color light-sensitive material as set forth is claim 14 wherein at least one of the blue-, green- and red-sensitive layers include a colored coupler for masking.

16. A silver halide color light-sensitive material comprising, on a support, at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, the weight-averaged wavelength, $\lambda_G$, of spectral sensitivity distribution of the green-sensitive silver halide emulsion layer being in the range of from 520 nm to 580 nm, the weight-averaged wavelength, $\lambda_{-R}$, of spectral sensitivity distribution of the interlayer effect received by the red-sensitive silver halide emulsion layer in the range of from 500 nm to 600 nm being in the range of from 500 nm to 560 nm and the difference between the wavelengths $\lambda_G$ and $\lambda_{-R}$ ($\lambda_G-\lambda_{-R}$) being 5 nm or more, wherein the spectral sensitivity distribution $S_G(\lambda)$ of the interlayer effect received by the red-sensitive emulsion layer satisfies the following conditions:

(i) the wavelength $\lambda_G^{max}$ at which $S_G(\lambda)$ is the maximum is in the range of from 527 nm to 580 nm;

(ii) the wavelength $\lambda_G^{80}$ at which $S_G(\lambda)$ equals to 80% of $S_G(\lambda_G^{max})$ is in the range of from 515 to 545 nm and from 551 to 590 nm; and (iii) the wavelength $\lambda_G^{40}$ at which $S_G(\lambda)$ equals to 40% of $S_G(\lambda_G^{max})$ is in the range of from 488 to 532 nm and from 568 to 605 nm, and wherein the light-sensitive material contains at least one member selected from the group consisting of a DIR compound and a color masking compound which provides the interlayer effect received by the red-sensitive emulsion layer.

17. The silver halide color light-sensitive materials as set forth in claim 16 wherein the wavelength $\lambda_G^{max}$, $\lambda_G^{80}$ and $\lambda_G^{40}$ are in the following ranges respectively:

(i) 535 nm$\leqq\lambda_G^{max}\leqq$560 nm;

(ii) 515 nm$\leqq\lambda_G^{80}\leqq$538 nm, and 551 nm$\leqq\lambda_G^{80}\leqq$578 nm; and (iii) 488 nm$\leqq\lambda_G^{40}\leqq$520 nm, and 568 nm$\leqq\lambda_G^{40}\leqq$595 nm.

18. A silver halide color light-sensitive material comprising, on a support, at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, the weight-averaged wavelength, $\lambda_G$, of spectral sensitivity distribution of the green-sensitive silver halide emulsion layer being in the range of from 520 nm to 580 nm, the weight-averaged wavelength, $\lambda_{-R}$, of spectral sensitivity distribution of the interlayer effect received by the red-sensitive silver halide emulsion layer in the range of from 500 nm to 600 nm being in the range of from 500 nm to 560 nm and the difference between the wavelengths $\lambda_G$ and $\lambda_{-R}$($\lambda_G-\lambda_{-R}$) being 5 nm or more, wherein the spectral sensitivity distribution $S_{-R}(\lambda)$ of the interlayer effect received by the red-sensitive emulsion layer satisfies the following conditions:

(a) the wavelength $\lambda_{-R}^{max}$ at which $S_{-R}(\lambda)$ is the maximum is in the range of from 490 nm to 560 nm;

(b) the wavelength $\lambda_{-R}^{80}$ at which $S_{-R}(\lambda)$ is equal to 80% of $S_{-R}(\lambda_{-R}^{max})$ is in the range of from 450 to 534 nm and from 512 to 566 nm; and (c) the wavelength $\lambda_{-R}^{40}$ at which $S_{-R}(\lambda)$ equals to 40% of $S_{-R}(\lambda_{-R}^{max})$ is in the range of from 400 to 512 nm and from 523 to 578 nm;

the spectral sensitivity distribution $S_G(\lambda)$ of the green-sensitive silver halide emulsion layer satisfies the following conditions:

(i) the wavelength $\lambda_G^{max}$ at which $S_G(\lambda)$ is the maximum is in the range of from 527 nm to 580 nm;

(ii) the wavelength $\lambda_G^{80}$ at which $S_G(\lambda)$ equals to 80% of $S_G(\lambda_G^{max})$ is in the range of from 515 to 545 nm and from 551 to 590 nm; and (iii) the wavelength $\lambda_G^{40}$ at which $S_G(\lambda)$ equals to 40% of $S_G(\lambda_G^{max})$ is in the range of from 488 to 532 nm and from 568 to 605 nm, and wherein the light-sensitive material contains at least one member selected from the group consisting of a DIR compound and a color masking compound which provides the interlayer effect received by the red-sensitive emulsion layer.

19. The silver halide color light-sensitive material as set forth in claim 18 wherein the wavelength $\lambda_{-R}^{max}$, $\lambda_{-R}^{80}$ and $\lambda_{-R}^{40}$ are in the following ranges respectively:

(a) 505 nm$\leqq\lambda_{-R}^{max}\leqq$545 nm;

(b) 492 nm$\leqq\lambda_{-R}^{80}\leqq$529 nm; and 517 nm$\leqq\lambda_{-R}^{80}\leqq$551 nm; and (c) 471 nm$\leqq\lambda_{-R}^{40}\leqq$507 nm, and 528 nm$\leqq\lambda_{-R}^{40}\leqq$563 nm;

and the wavelength $\lambda_G^{max}$, $\lambda_G^{80}$ and $\lambda_G^{40}$ and are in the following ranges respectively:

(i) 535 nm$\leqq\lambda_G^{max}\leqq$560 nm;

(ii) 515 nm$\leqq\lambda_G^{80}\leqq$538 nm, and 551 nm$\leqq\lambda_G^{80}\leqq$578 nm; and (iii) 488 nm$\leqq\lambda_G^{40}\leqq$520 nm, and 568 nm$\leqq\lambda_G^{40}\leqq$595 nm.

20. The silver halide color light-sensitive material as set forth in claim 1 wherein it contains at least one member selected from DIR couplers which release development inhibiting moieties which is deactivated in a developing solution and timing DIR couplers.

21. The silver halide color light-sensitive material as set forth in claim 1 wherein spectral sensitivity distribution $S_R(\lambda)$ of the red-sensitive silver halide emulsion layer lies within the area represented by the hatched area on the accompanying FIG. 10A.

22. The silver halide color light-sensitive material as set forth in claim 1 wherein spectral sensitivity distribution $S_{-G}(\lambda)$ of the interlayer effect received by the green-sensitive silver halide emulsion layer lies within the area represented by the hatched area on the accompanying FIG. 11B.

23. The silver halide color light-sensitive material so set forth in claim 1 wherein spectral sensitivity distribution of $S_B(\lambda)$ of the blue-sensitive silver halide emulsion layer lies within the area represented by the hatched area on the accompanying FIG. 12A.

24. The silver halide color light-sensitive material as set forth in claim 1 wherein spectral sensitivity distribution $S_{-B}(\lambda)$ of the interlayer effect received by the blue-sensitive silver halide emulsion layer lies within the area represented by the hatched area on the accompanying FIG. 12B.

* * * * *